US010150594B2

(12) United States Patent
Hillmann et al.

(10) Patent No.: US 10,150,594 B2
(45) Date of Patent: Dec. 11, 2018

(54) CROWN CAP AND CLOSING DEVICE

(71) Applicants: Heinz Hillmann, Obrigheim (DE); Andreas Krieg, Dittelsheim-Hessloch (DE)

(72) Inventors: Heinz Hillmann, Obrigheim (DE); Andreas Krieg, Dittelsheim-Hessloch (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/277,360

(22) Filed: Sep. 27, 2016

(65) Prior Publication Data

US 2017/0081088 A1 Mar. 23, 2017

Related U.S. Application Data

(63) Continuation-in-part of application No. PCT/EP2015/056263, filed on Mar. 24, 2015.

(30) Foreign Application Priority Data

Mar. 27, 2014 (DE) ..... 10 2014 104 316

(51) Int. Cl.
*B65D 41/00* (2006.01)
*B65D 41/42* (2006.01)
(Continued)

(52) U.S. Cl.
CPC ..... *B65D 41/42* (2013.01); *B65C 3/26* (2013.01); *B65D 41/12* (2013.01); *B65D 53/02* (2013.01);
(Continued)

(58) Field of Classification Search
CPC ..... B65D 41/42; B65D 41/12; B65D 53/02; B65C 3/26; B67B 3/02; B67B 3/023;
(Continued)

(56) References Cited

U.S. PATENT DOCUMENTS 1,345,722 A * 7/1920 White ..... B65D 41/12 215/295
1,490,022 A 4/1924 Philippides
(Continued)

FOREIGN PATENT DOCUMENTS

DE 1018121 10/1957
DE 3515334 10/1986
(Continued)

*Primary Examiner* — Ernesto Grano
(74) *Attorney, Agent, or Firm* — Nils H. Ljungman & Associates

(57) ABSTRACT

A crown cap and closing device. The abstract of the disclosure is submitted herewith as required by 37 C.F.R. § 1.72(b). As stated in 37 C.F.R. § 1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 40 Drawing Sheets

(51) Int. Cl.

| | |
|---|---|
| ***B65D 41/12*** | (2006.01) |
| ***B67B 3/02*** | (2006.01) |
| ***B65C 3/26*** | (2006.01) |
| ***B65D 53/02*** | (2006.01) |
| ***B67C 3/24*** | (2006.01) |
| ***B67C 3/28*** | (2006.01) |
| ***B67C 7/00*** | (2006.01) |
| *B67C 3/22* | (2006.01) |

(52) U.S. Cl.
CPC ..... *B67B 3/02* (2013.01); *B67B 3/023* (2013.01); *B67C 3/24* (2013.01); *B67C 3/28* (2013.01); *B67C 7/004* (2013.01); *B67C 2003/228* (2013.01)

(58) Field of Classification Search
CPC .. B67C 3/24; B67C 3/28; B67C 7/004; B67C 203/228
USPC ..... 215/274
See application file for complete search history.

(56) References Cited

U.S. PATENT DOCUMENTS 1,616,516 A * 2/1927 Taliaferro ..... B65D 41/12 215/327
2,063,454 A * 12/1936 McManus ..... B65D 41/12 215/328
2,109,699 A * 3/1938 Hutaff, Jr. ..... B65D 41/42 215/254
2,490,791 A * 12/1949 Erb ..... B65D 41/42 215/305
2,974,816 A 3/1961 Ford
3,203,570 A * 8/1965 Bindschedler ..... B65D 41/12 215/328
3,275,178 A * 9/1966 Lovell ..... B65D 51/243 215/277
3,283,935 A * 11/1966 Samuels ..... B65D 41/42 215/256
3,514,004 A * 5/1970 Hammersmith ..... B65D 41/12 215/328
3,865,268 A * 2/1975 Coop ..... B65D 41/44 215/253
4,002,260 A * 1/1977 Coop ..... B65D 41/12 215/305
4,055,266 A * 10/1977 Amabili ..... B65D 41/42 215/252
4,385,708 A * 5/1983 Curry ..... B65D 41/48 215/254
4,627,548 A * 12/1986 Thompson ..... B65D 41/0464 215/295
4,776,476 A * 10/1988 Simard ..... B65D 41/0485 215/230
4,782,969 A * 11/1988 Henning ..... B65D 41/42 215/295
4,896,781 A * 1/1990 Simard ..... B65D 41/12 215/328
5,806,700 A * 9/1998 Henning ..... B65D 1/0246 215/238
5,875,906 A * 3/1999 Price ..... B29C 57/12 215/252
6,006,933 A * 12/1999 Henning ..... B65D 41/12 215/326
9,499,312 B1 * 11/2016 Gilliam ..... B65D 41/34
2010/0084364 A1 * 4/2010 Martin ..... B65D 41/34 215/201
2016/0023812 A1 * 1/2016 Kikel ..... B65D 41/02 235/492

FOREIGN PATENT DOCUMENTS

DE 4018121 12/1991
DE 4036306 6/1992
DE 102014010626 5/2015

* cited by examiner

FIG. 3A
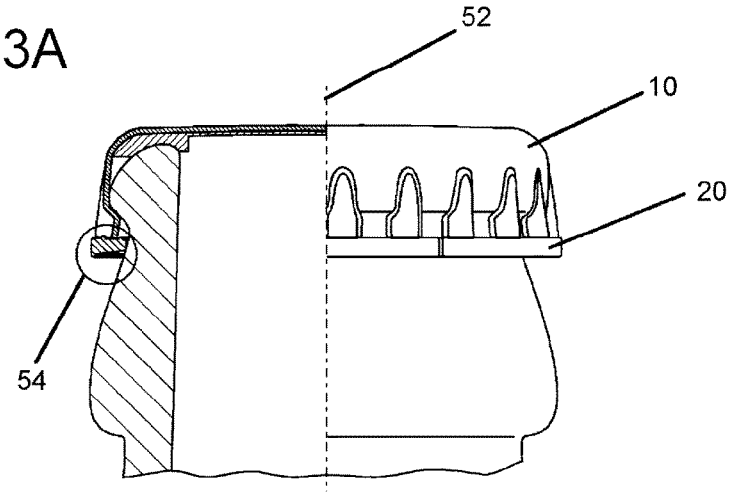
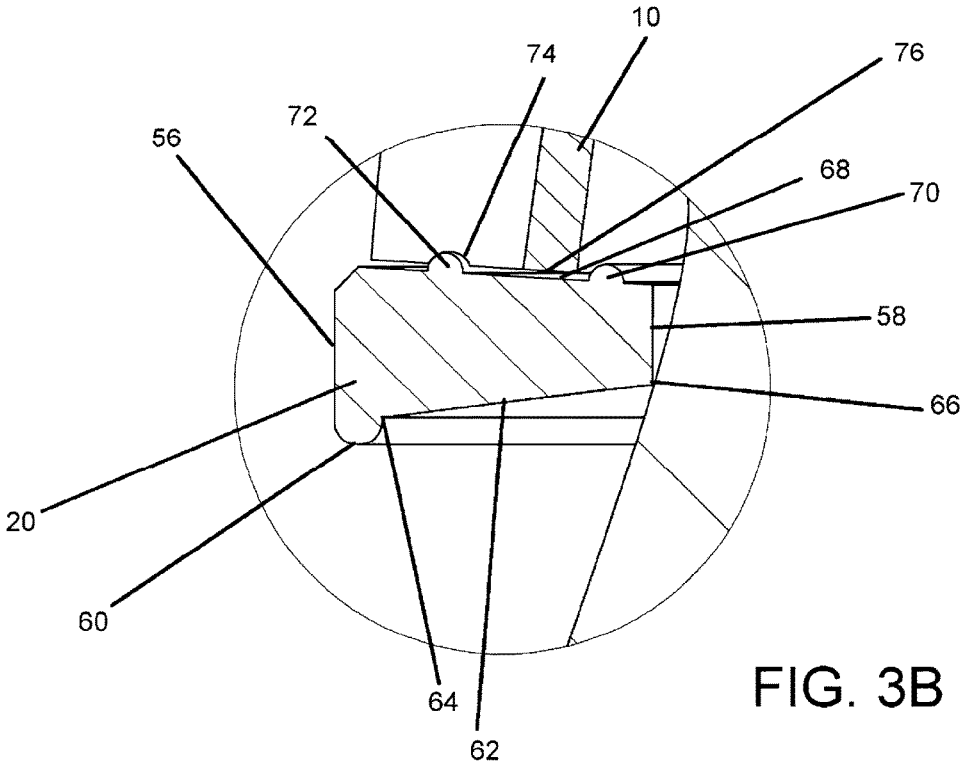
FIG. 3B

CROWN CAP AND CLOSING DEVICE

CONTINUING APPLICATION DATA

This application is a Continuation-In-Part application of International Patent Application No. PCT/EP2015/056263, filed on Mar. 24, 2015, which claims priority from Federal Republic of Germany Patent Application No. 10 2014 104 316.2, filed on Mar. 27, 2014. International Patent Application No. PCT/EP2015/056263 was pending as of the filing date of this application. The United States was an elected state in International Patent Application No. PCT/EP2015/056263.

BACKGROUND

1. Technical Field

The present application relates to a crown cap and closing device.

2. Background Information

Background information is for informational purposes only and does not necessarily admit that subsequently mentioned information and publications are prior art.

The present application comprises a crown cap for bottles (glass bottles) and a suitable closing method.

Crown caps as closures for containers, for example for beverage bottles made of glass are very usual and well-known, for example for beer and soft drink bottles. In this context, these comprise a circular sheet piece with a crown-shaped bend edge and a sealing insert. This was originally of cork, which as a compressible intermediate piece provided the necessary and/or desired sealing tightness between the bottle neck and the sheet piece. Today, polyvinyl chloride (PVC) or polyethylene (PE) are usual. For reasons of protection, crown caps are, as a rule, coated with protective lacquers.

The most conventionally used crown cap has twenty-one jagged teeth, wherein the advantage of and/or reason for the odd number of teeth lies in the fact that they are not located directly opposite one another, and thereby tipping in the feed delivery devices is prevented, restricted, and/or minimized.

Crown caps are placed onto the containers by means of a closure machine, which conveys the crown caps with the aid, for example, of a magnetic stamp or punch, and presses the caps onto the bottle neck. At the same time, a cylindrical section is lowered around the crown cap, which essentially ensures and/or promotes that the jagged teeth edge is bent around, or is seamed around the mouth region of the container.

Some methods for the closing of containers include crown caps that are closed onto the mouth end of a container with the formation of a seal press seating between the closure element and the container, wherein, in a first closure phase, a temporary clamp connection is formed, and, in a subsequent closure phase, the permanent or substantially permanent seal press seating. In this situation, the temporary clamp connection of the closure element with the container is formed by plastic shaping of the crown cap. The closure process according to is multiple-step in this situation, with different, i.e. increasing closure forces. A further crown cap closing device may comprise an attachment head, which comprises projecting movable pin elements for the seaming of the crown cap edge. In this situation, a pneumatic drive device is provided in order to produce a feed movement for the attachment head.

A possibly hygienic device may include the closure of the container takes place in a sterile space, which is produced by an inert gas.

Even though the method and the devices usually used for this are in widespread use, a problem lies in the fact that, during the filling process, directly upstream of the closing device, the container mouth is frequently wetted with product, which can then penetrate into the cavity which is present beneath the crown cap teeth laid in place and seamed around the mouth, in which mold formation can occur. In any event, the spaces beneath the crown cap from a partially open cavity, in which contamination cannot be avoided, restricted, and/or minimized, and with which the consumer comes into contact with the lips.

OBJECT OR OBJECTS

An object of the present application now comprises providing a crown cap closure which comprises improved hygienic properties.

SUMMARY

This object is solved according to the present application with a crown closure system according to the present application, wherein the closure is solved with a method according to the present application.

In this situation, this cap-like closing system for containers comprises a crown cap comprising a plurality of jagged or teeth-like shaped ends, formed at least partially from a metallic and/or aluminum-containing material, wherein the crown caps are shaped in such a way that the shaped ends, after being shaped in the specified manner and closing the container, form one or more cavities between the outer container surface and the shaped ends. In this situation, beneath the crown cap, a ring or ring element projects in the axial direction, which represents a lower delimiting wall of the cavities. This ring further represents a retaining ring, which, at the shaping of the crown caps at the moment of opening, is deformed or broken.

The closed ring comprises in this situation at least one first inner region, which in the closed state exhibits the same inclination angle as the ring surface/plane which is tensioned by the free under edge of the shaped ends. In this situation, one possible exemplification comprises the fact that connected to the first inner region is a second ring-shaped region, which exhibits the same or a sharper inclination or cambering towards the first region. If necessary and/or desired, vertical holes or apertures can be provided in the ring, in order for fluid, such as condensation water or product, to be easily transported away downwards.

In at least one possible exemplification, the ring comprises a contour, and that the closed ring exhibits, in the direction of the container axis of the upright container, a downwards inclination or cambering, in order to favor the running off of fluids from the upper side of the ring.

The ring can in this situation be formed from any suitable plastic or cellulose material, but in one possible exemplification is formed from a plastic, such as polyethylene terephthalate (PET), polyethylene in high density, or the like. In one possible exemplification, the ring comprises predetermined break points, and/or is segmented or formed from segments.

If the ring is formed from segments, at least two of the segments can be connected by means of non-detachable connections, latching into one another or connected by positive fit connection. In this respect, a hinge-like transition area can be formed between two or more segments of the ring. In such an exemplification, too, provision can also be made for at least one latching non-detachable connection. Such a (latching engagement) connection is possibly formed from the free ends of two adjacent segments.

With an alternative exemplification, the ring is an integral part of the crown cap, in that the ring is formed of segments. In interaction with the shaped ends of the basic body, shaped to form the closure, these segments can form a closed ring or, alternatively, are mounted and positioned by means of carrier webs in the shaped ends of the crown cap, such that this joins up, during the shaping of the shaped ends to form the container closure, to form a closed ring, i.e. alone and not in interaction with the shaped ends.

On the machine side, in order to produce the exemplifications referred to heretofore, the corresponding devices, such as delivery lines of crown caps (basic bodies), rings or ring segments, grippers, etc. are provided for, which are arranged in a suitable manner.

The process steps which are otherwise known, upstream and downstream of the closing device, can be combined as required and/or desired, in an analogous manner. These are suitable inspection and monitoring units, upstream and/or downstream of the closer, cleaning and hygiene units, in order to suction away impurities or contamination and, as appropriate, carry out disinfection of the closures. In at least one possible exemplification, a closure inspection is provided for downstream of the closing device, which checks the proper closure quality and presence of the crown cap and, as appropriate, the retaining rings provided beneath the crown cap.

As feed delivery systems, known units are used, which transport the closures to the closing device, and in this situation take account of and determine the alignment and position. The desired direction orientation is retained in such transport units. Additionally, the transfer of the crown caps to the closing device takes place by means of pick & place station(s), by means of blower devices, or by other suitable elements.

If required and/or desired, a mouth shower arrangement can be provided upstream of the actual closure step, in order, for example, to flush away foam residues.

The closing device itself comprises known closing heads, which are capable of applying the crown caps described. The closing device is possibly a closing device in a circulating design, with a plurality of closing stations, which in each case comprise at least one closing tool.

In this situation, in at least one possible exemplification, downstream of the closing position or unit, a hardening and/or embrittlement unit is provided, although this can also be an integral constituent part of the closing station, which can be activated, i.e. switched on, as required and/or desired.

With a possible variant, the ring is applied in two or more part segments to the container. For this purpose, for example, a first segment is applied at a first application point of the conveying path, and, following this, the second, missing segment is then applied at a second application point.

For example, a first ring segment, which covers more than one hundred eighty degrees of the contact region, can be applied in the region of a conveying element, upstream of the closing device, for example in the inlet star to the closing device. The further ring segment(s) can then be conveyed to the closing device, and there the entire ring can be introduced, closing upstream or downstream of the closing of the containers.

In this situation, as application or transfer tools, grippers or clips are possibly, with which the ring segments can be laid in the flank of the gripper arms or tongs, in that the flanks of the gripper arms or tongs are shaped in the form of grooves or channels in a counter (negative) contour analogous to the ring or ring segment.

The above-discussed exemplifications of the present invention will be described further herein below. When the word "invention" or "exemplification of the invention" is used in this specification, the word "invention" or "exemplification of the invention" includes "inventions" or "exemplifications of the invention", that is the plural of "invention" or "exemplification of the invention". By stating "invention" or "exemplification of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

FIG. 3A shows the ring in a closed position about the crown cap;

FIG. 3B shows a portion of FIG. 3A within an illustrative ring;

DESCRIPTION OF EXEMPLIFICATION OR EXEMPLIFICATIONS

Figure 1A:
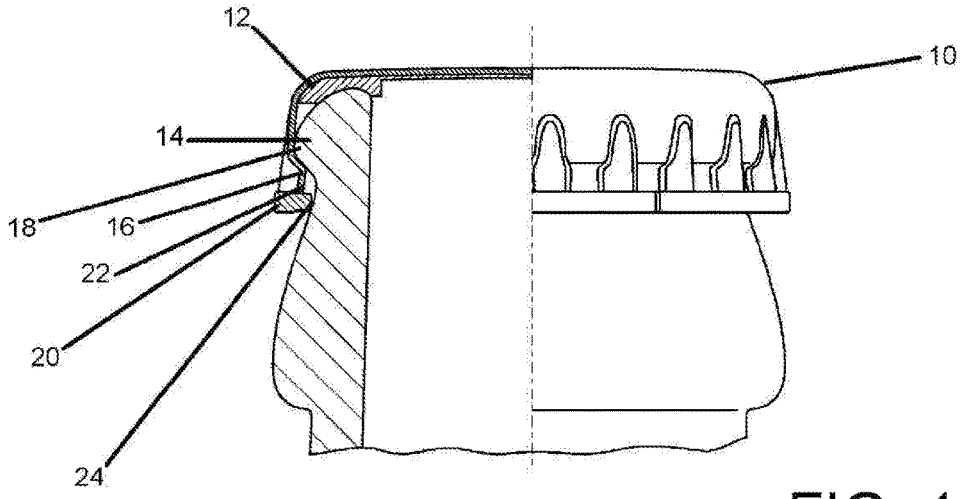
FIG. 1A shows an exemplification with the cap-like closing system installed on a bottle.

FIG. 1A shows an exemplification with the cap-like closing system installed on a bottle. The system comprises a metal crown cap 10 with an upper seal 12 disposed between the metal crown cap 10 and the extreme upper mouth of the bottle 14 with the jagged or tooth-shaped ends 16 of the crown cap 10 pressed against the bottom portion 18 of the bottom portion of the furthest upward extending portion of the bottle 14.

A ring or ring element projects in the axial direction downwardly from the extreme end 22, which points downwardly, of the crown cap 10. The ring 20 projects in at least a first inner region 24, which upon being installed, exhibits the same inclination angle as the ring surface/plane which is tensioned by the free upper edges of the jagged or tooth-shaped ends 16.

Figure 1B:
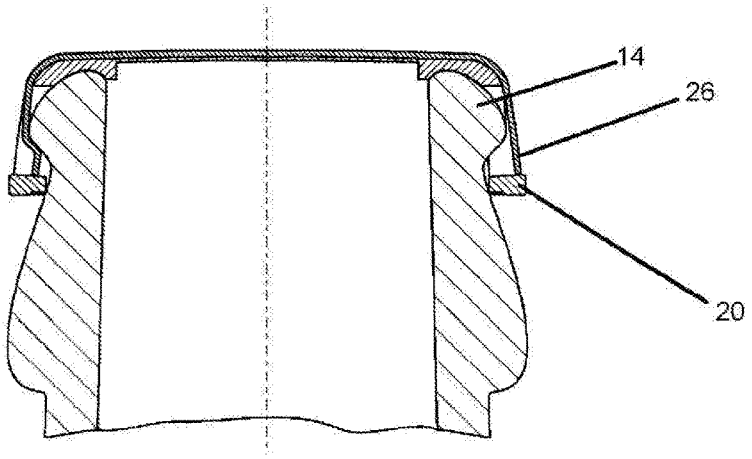
FIG. 1B shows the exemplification of FIG. 1A, in a sectional view.

FIG. 1B shows the exemplification of FIG. 1A, in a sectional view, which shows both the left and right side of the bottle 14 with the cap-like closing system installed.

As can be seen, the right-hand portion of the bottle 14 with the crown cap 10 installed covers the open portion 26 of the jagged or tooth-shaped shaped ends 16. The right-hand portion of the figure shows the portion of the jagged or tooth-shaped shaped ends 16 which has not been collapsed by the closing of the bottle 14. The ring 20 as shown on the right-hand portion of the figure closes or seals the open portion 26.

A recess 24 is formed on the bottom portion of the ring or ring segments 20.

Figure 2A:
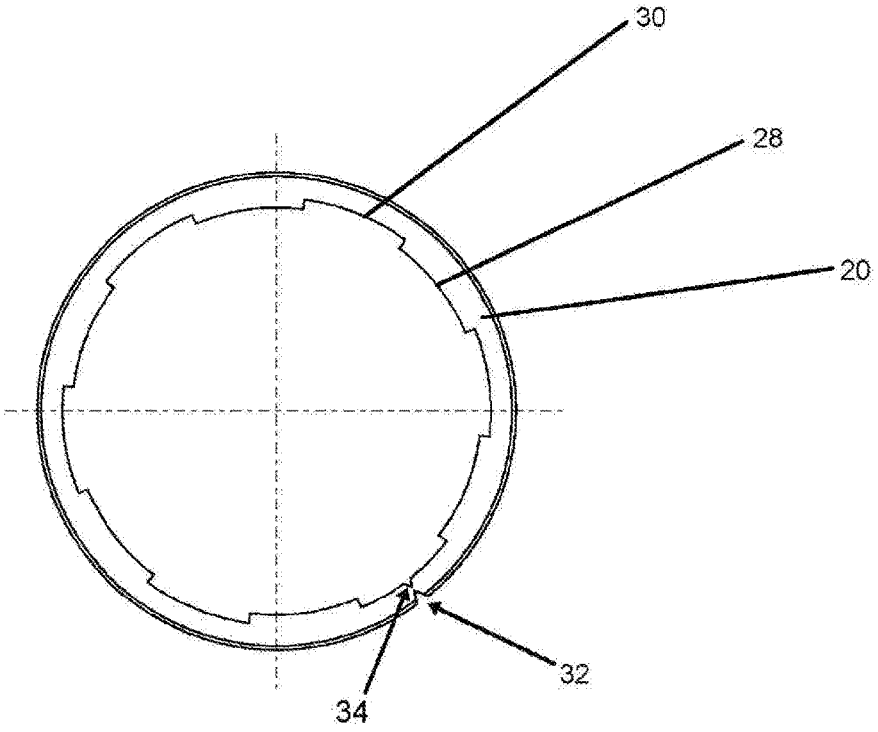
FIG. 2A shows the ring from a top view.

FIG. 2A shows the ring 20 from a top view which has inward projections 28 toward the bottle 14 and recesses 30 disposed somewhat from the bottle 14. In addition, a narrowing portion of the ring 20 is shown by two notches 32 and 34, which may be a break point that permits the ring 20 to be broken upon opening of the bottle 14.

The ring 20 may be formed in segments, which will be shown in more detail later.

Figure 2B:
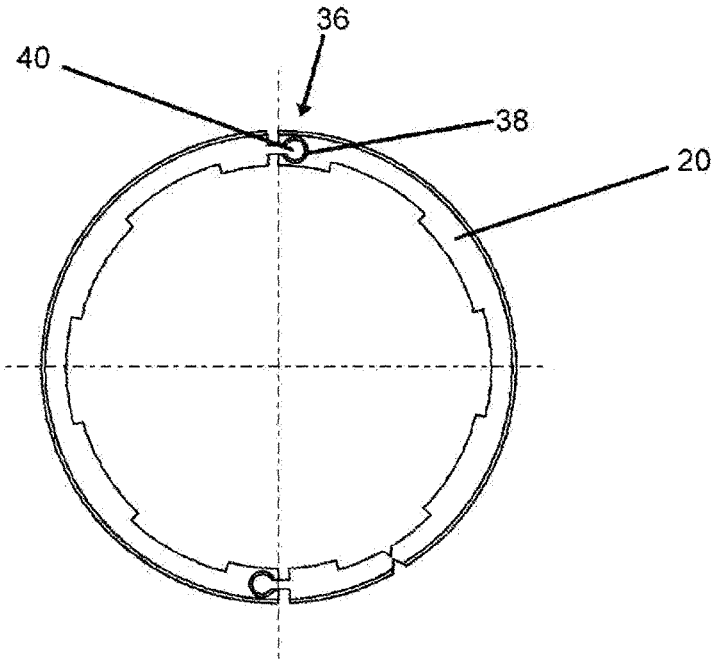
FIG. 2B shows the ring in another exemplification with devices.

FIG. 2B shows the ring 20 in another exemplification with devices 36, which permit the ring 20 to be assembled during installation of the ring 20. In this exemplification, the device 36 is formed by a cylindrical or spherical hole 38 in one portion of the ring 20 and a spherical or cylindrical ball or other insert 40, which attaches into the cylindrical or spherical hole 38.

This device or connection 36 is constructed so that connection between the hole 38 and insert 40 can not readily be detached unless the device 36 is broken. Further, there are two devices or connections 36 shown in FIG. 2B.

Figure 2D:
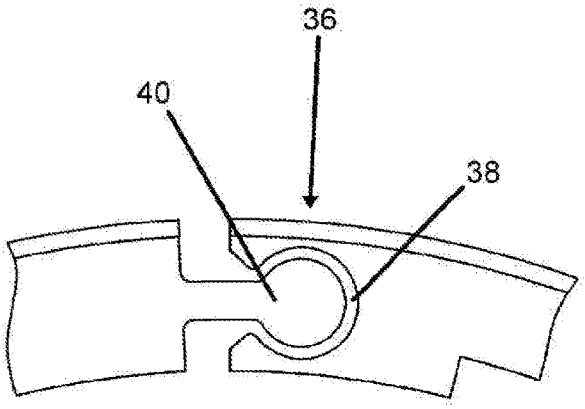
FIG. 2D shows an enlarged view of the device or connection, including the hole and the insert.
Figure 2C:
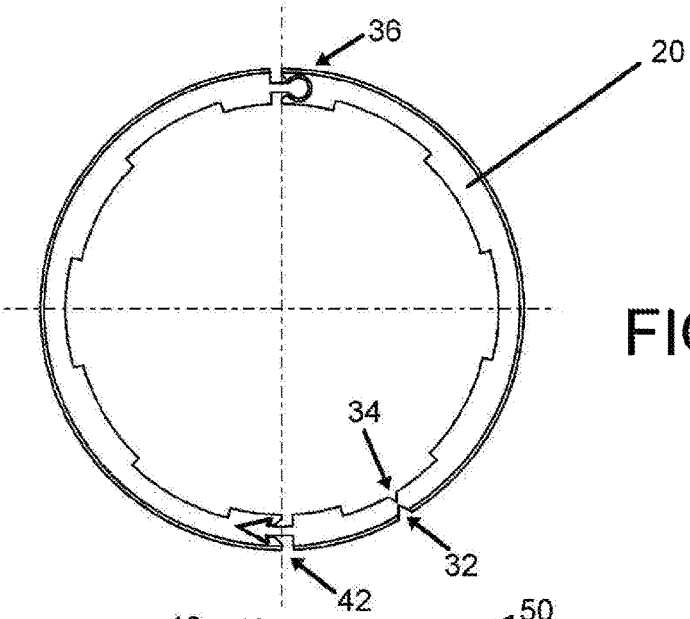
FIG. 2C shows two different possible exemplifications of the device or connection installed and attached.

FIG. 2C shows two different possible exemplifications of the device or connection 36 installed and attached. A different exemplification 42 shown in more detail in FIG. 2E may be used as shown with device 36 or where both the connections 36 are in both locations or the top of FIG. 2C or one exemplification 36 could be used for the top and another exemplification 42 could be used at the bottom of that figure such that the connection 42 could be used at both the top and the bottom of FIG. 2C.

FIG. 2D shows an enlarged view of the device or connection 36, including the hole 38 and the insert 40.

Figure 2E:
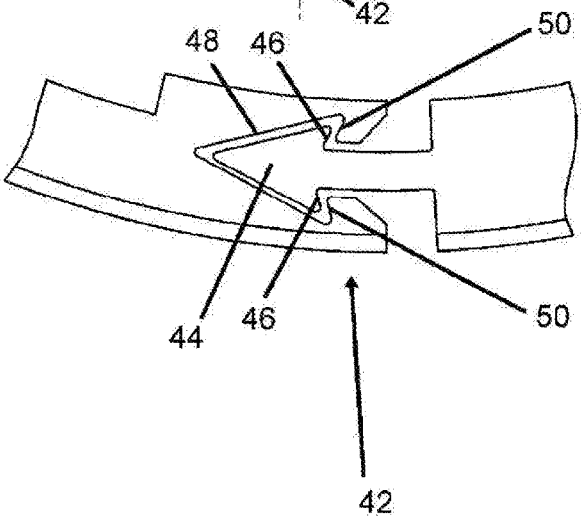
FIG. 2E shows the connection as shown in FIG. 2C in greater detail.

FIG. 2E shows the connection 42 as shown in FIG. 2C in greater detail. An arrow portion 44 is shaped with undercuts 46, which connect to the hole 48, which is configured to accept the arrow portion 44. The arrow portion 44 has undercuts 50 which engage with the undercuts 46 such that the connection 42 cannot be detached without breaking the ring 20, once installed.

The devices or connections 36 and 42 are connected in what may be called a non-detachable manner, and further FIG. 2C shows the ring 20 in two segments, which are attached in a non-detachable manner.

In FIG. 2C, the notches 32 and 34 permit the ring 20 to be hinged together with a hinging action of the notches 32 and 34. Thus a closure is formed by the free ends of the two adjacent segments of the ring 20.

FIG. 3A shows the ring 20 in a closed position about the crown cap 10, in which the closed ring 20 comprises a counter which exhibits, in the direction of the container axis 52 of the upright container 14, a downwards inclination or cambering.

FIG. 3B shows a portion of FIG. 3A within an illustrative ring 54, which shows solely a portion of the ring 20. FIG. 3B shows the illustrative ring 54 enlarged.

The ring 20 is shown with an outer portion 56 and an inner portion 58. Outer portion 56 and inner portion 58 are substantially parallel to the container axis 52.

A lower edge 60 of the ring 20 extends about at least one portion of the ring 20 around the bottle 14. A lower surface 62 of the ring 20 extends upwardly from the edge portion, which has a section which is semicircular from the section view in FIG. 3B. The lower edge 60 and lower surface 62 intersect at a corner portion 64. The upper edge of surface 62 makes contact with the bottle 14 at point or circular contact area 66.

The upper surface 68 of the ring 20 has two circularly extending portions 70 and 72 along the length of each segment of the ring 20. The circularly extending portion 72 is disposed at least partially within a semicircular groove 74. The lower surface of the metallic crown cork 10 extends to or almost extends to the upper surface 68 of the ring 20. Thus the closed ring comprises a contour, which exhibits, in the direction of the container axis 52 of the upright container 14, a downwards inclination or cambering.

Figure 4:
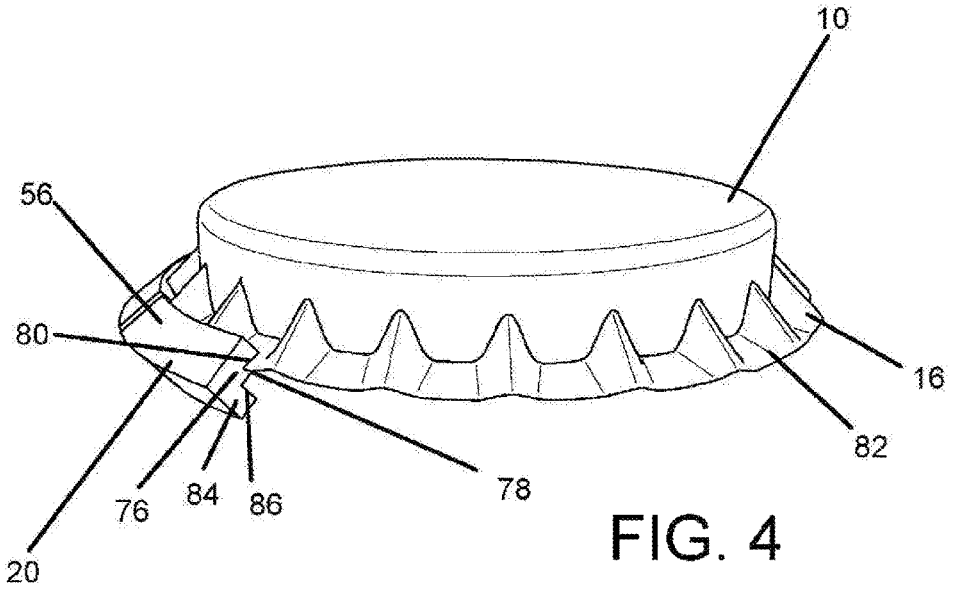
FIG. 4 shows another possible exemplification of the ring.

As shown in FIG. 4, the ring 20 forms an integral part of the crown cap 10, in that the ring 20 is formed from segments, which are mounted and positioned by means of carrier webs 76 in the shaped ends of the crown cap 20, and which, at the shaping of the shaped ends, join to the container closure to form a closed ring 20. The carrier webs 76 are formed by extensions 78 and 80.

The segments of ring 20 are shown disposed at an angle from the container axis 52. The web 76 show the portion thereof extensions 78 and 80 grasping the edge 82 so that the ring segments can be held onto the crown cap 10 prior to the deformation of the jagged or tooth-shaped shaped ends 16.

The segments of the ring 20 have circumferential end portions 84 and a recess 86, which, upon installation, extends before the jagged or tooth-shaped shaped ends 16 of the crown cork 10.

Figure 5:
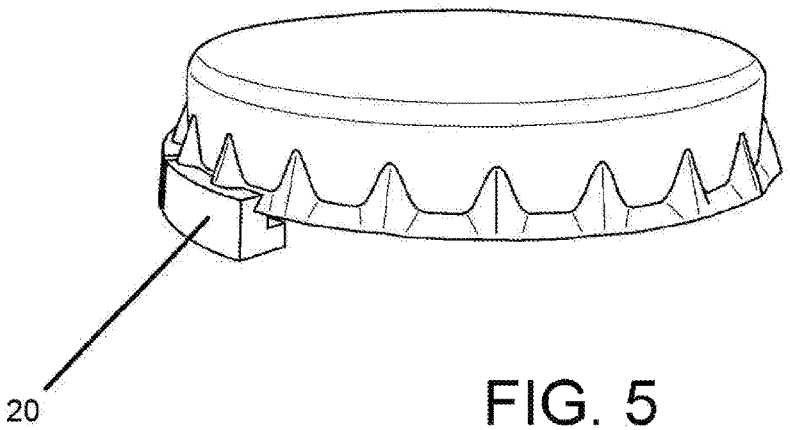
FIG. 5 shows the ring segments of the ring.

FIG. 5 shows the ring segments of the ring 20 installed such that the outer surface of the ring 20 is parallel or substantially parallel to the container axis 52.

The ring 20 may be made of only two sections or segments or many sections or segments. These section or segments may be in the order of approximately ten degrees about the circumference of the crown cap 10.

Figure 6:
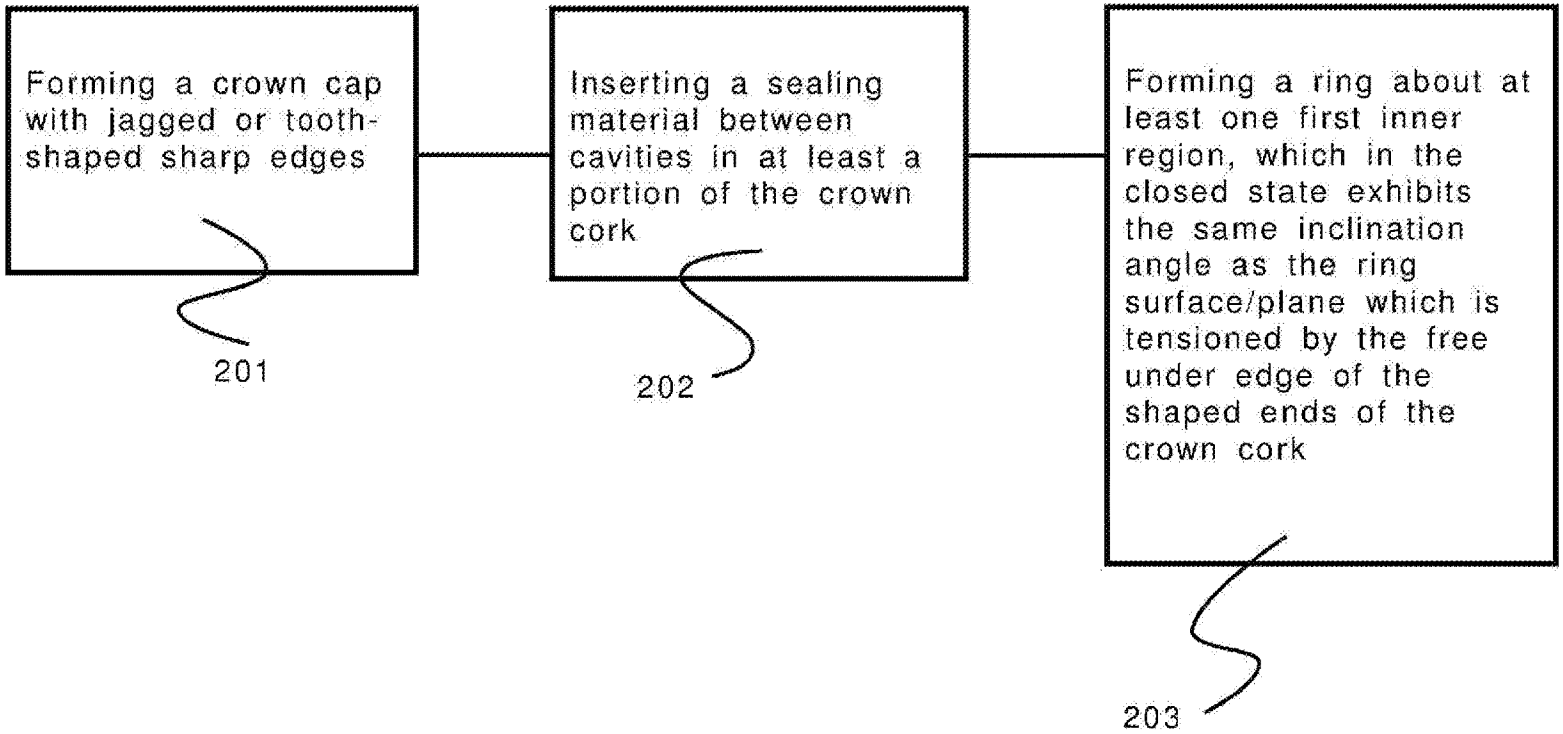
FIG. 6 is a block diagram of one possible exemplification of the method according to the present application.

FIG. 6 is a block diagram of one possible exemplification of the method according to the present application. One step in the method as shown in FIG. 6, shown by 201, includes forming a crown cap with jagged or tooth-shaped sharp edges. A following or subsequent step in the method as shown in FIG. 6, shown by 202, includes inserting a sealing material between cavities in at least a portion of the crown cork. A following or subsequent step in the method as shown in FIG. 6, shown by 203, includes forming a ring about at least one first inner region, which in the closed state exhibits the same inclination angle as the ring surface/plane which is tensioned by the free under edge of the shaped ends of the crown cork.

Figure 7:
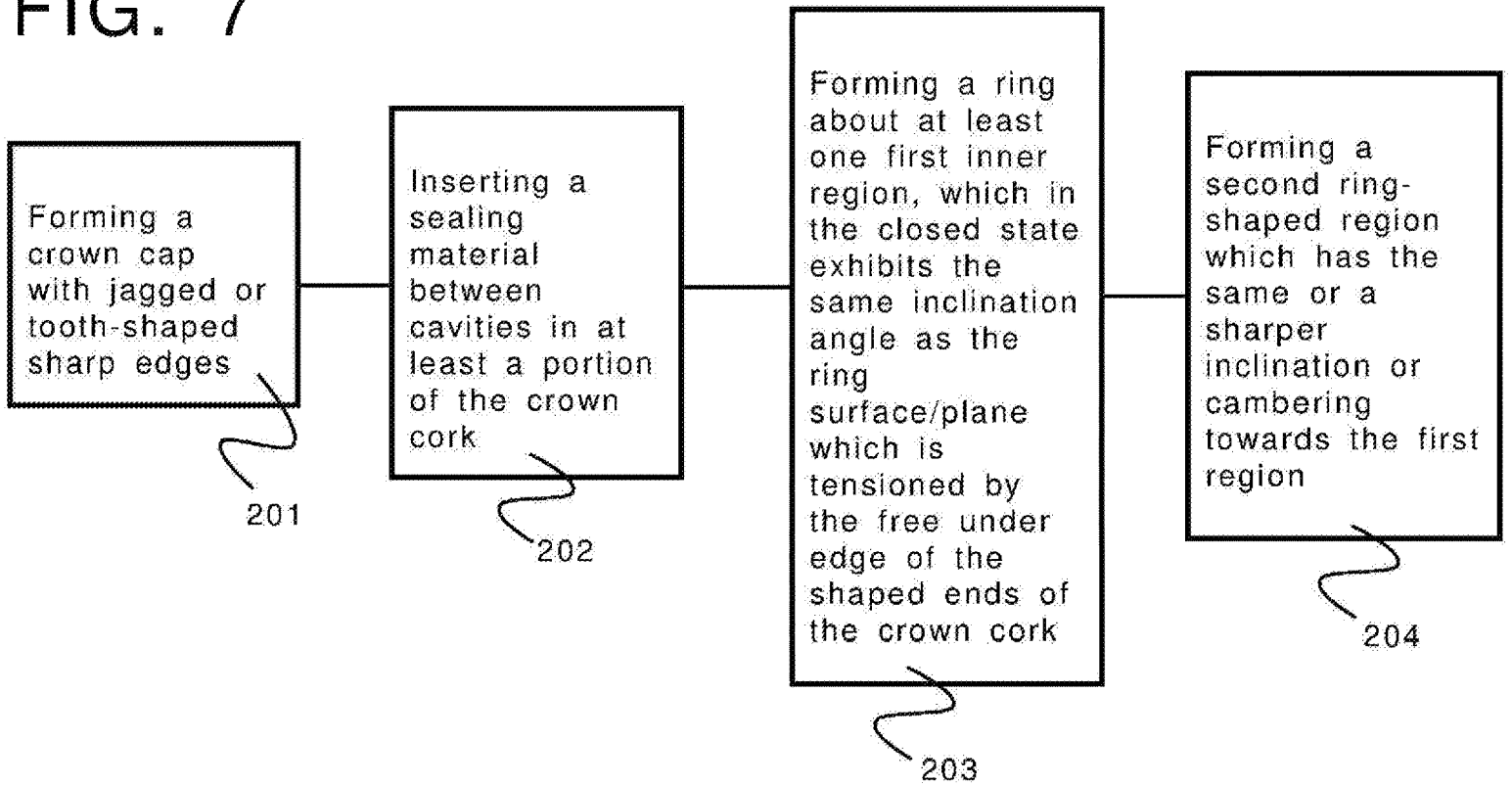
FIG. 7 is a block diagram of one possible exemplification of the method according to the present application.

FIG. 7 is a block diagram of one possible exemplification of the method according to the present application. One step in the method as shown in FIG. 7, shown by 201, includes forming a crown cap with jagged or tooth-shaped sharp edges. A following or subsequent step in the method as shown in FIG. 7, shown by 202, includes inserting a sealing material between cavities in at least a portion of the crown cork. A following or subsequent step in the method as shown in FIG. 7, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 7, shown by 204, includes forming a second ring-shaped region which has the same or a sharper inclination or cambering towards the first region.

Figure 8:
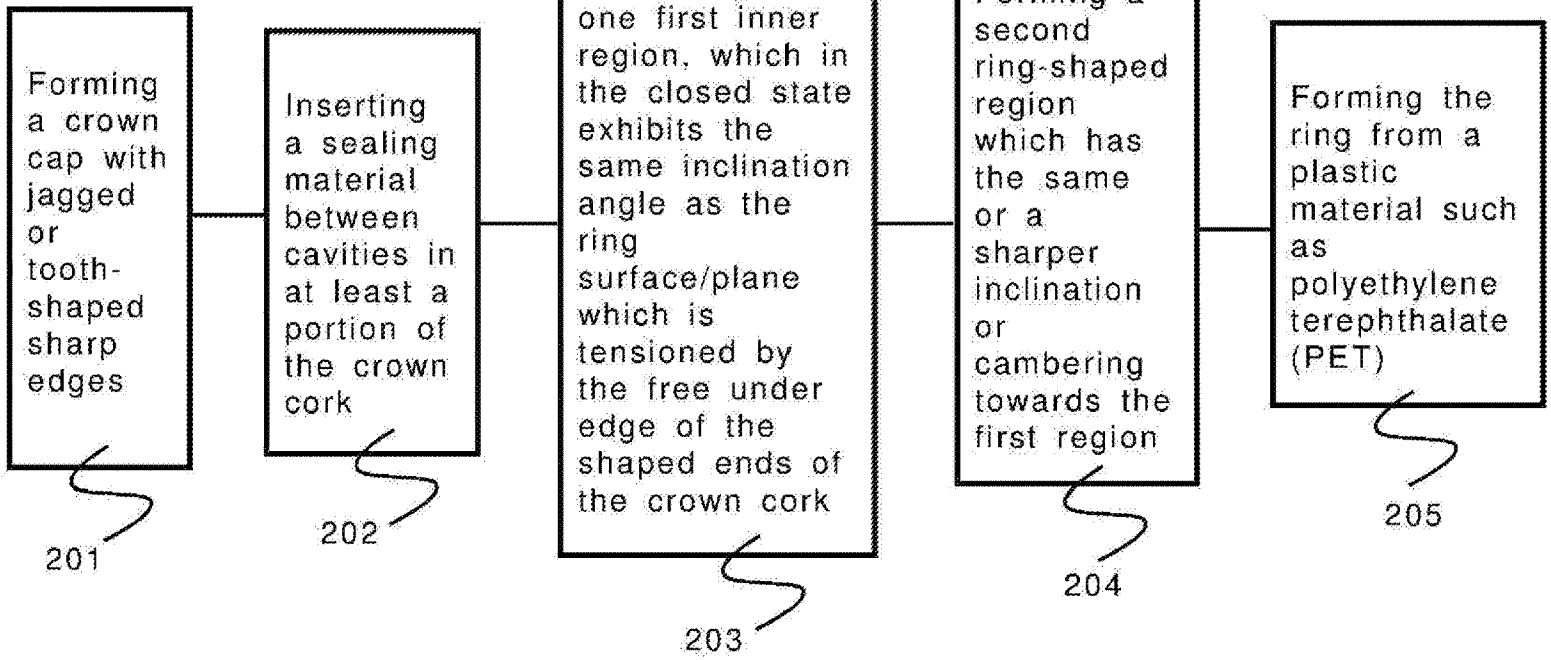
FIG. 8 is a block diagram of one possible exemplification of the method according to the present application.

FIG. 8 is a block diagram of one possible exemplification of the method according to the present application. One step in the method as shown in FIG. 8, shown by 201, includes forming a crown cap with jagged or tooth-shaped sharp edges. A following or subsequent step in the method as shown in FIG. 8, shown by 202, includes inserting a sealing material between cavities in at least a portion of the crown cork. A following or subsequent step in the method as shown in FIG. 8, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 8, shown by 204, includes forming a second ring-shaped region which has the same or a sharper inclination or cambering towards the first region. A following or subsequent step in the method as shown in FIG. 8, shown by 205, includes forming the ring from a plastic material such as polyethylene terephthalate (PET).

Figure 9:
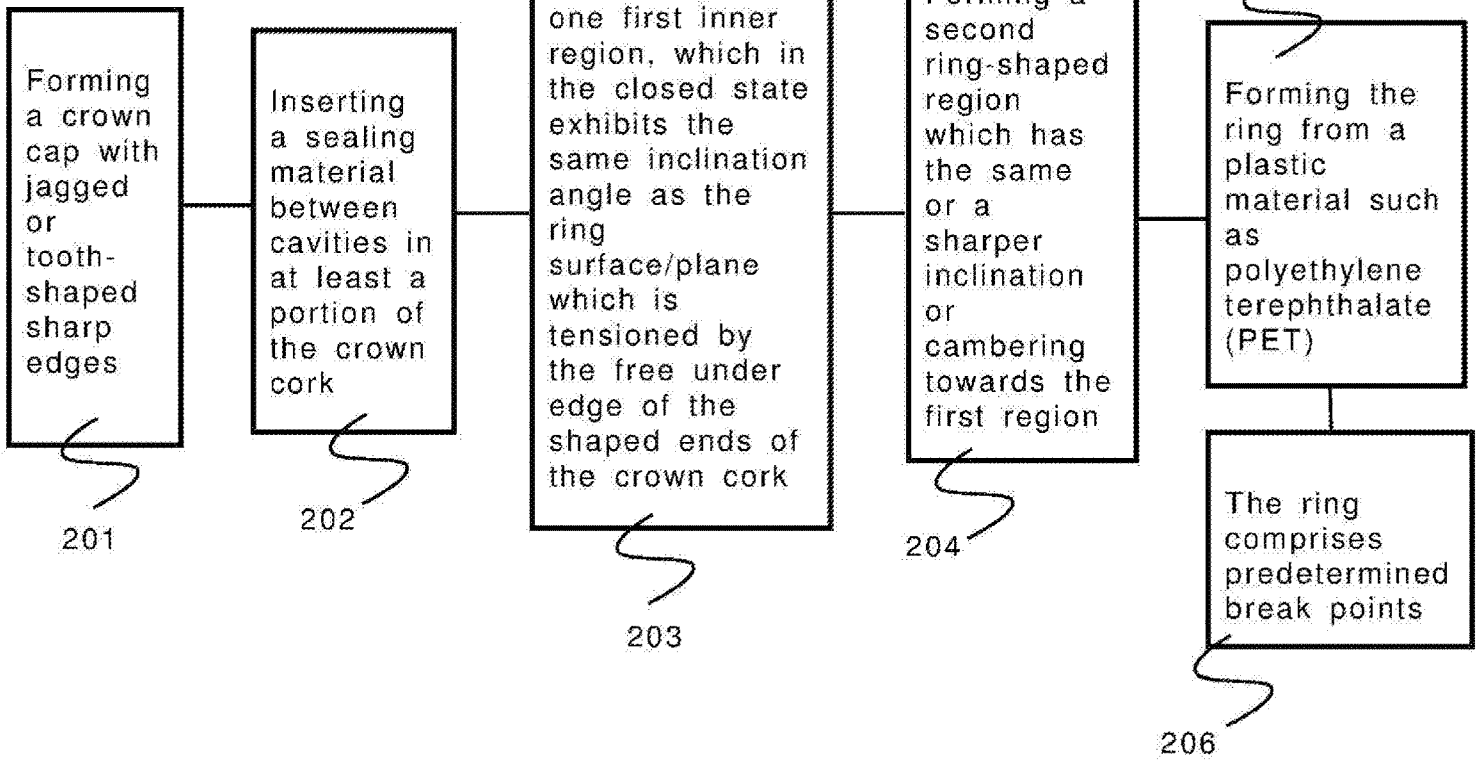
FIG. 9 is a block diagram of one possible exemplification of the method according to the present application.

FIG. 9 is a block diagram of one possible exemplification of the method according to the present application. One step in the method as shown in FIG. 9, shown by 201, includes forming a crown cap with jagged or tooth-shaped sharp edges. A following or subsequent step in the method as shown in FIG. 9, shown by 202, includes inserting a sealing material between cavities in at least a portion of the crown cork. A following or subsequent step in the method as shown in FIG. 9, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 9, shown by 204, includes forming a second ring-shaped region which has the same or a sharper inclination or cambering towards the first region. A following or subsequent step in the method as shown in FIG. 9, shown by 205, includes forming the ring from a plastic material such as polyethylene terephthalate (PET). A following or subsequent step in the method as shown in FIG. 9, shown by 206, includes the ring comprising predetermined break points.

Figure 10:
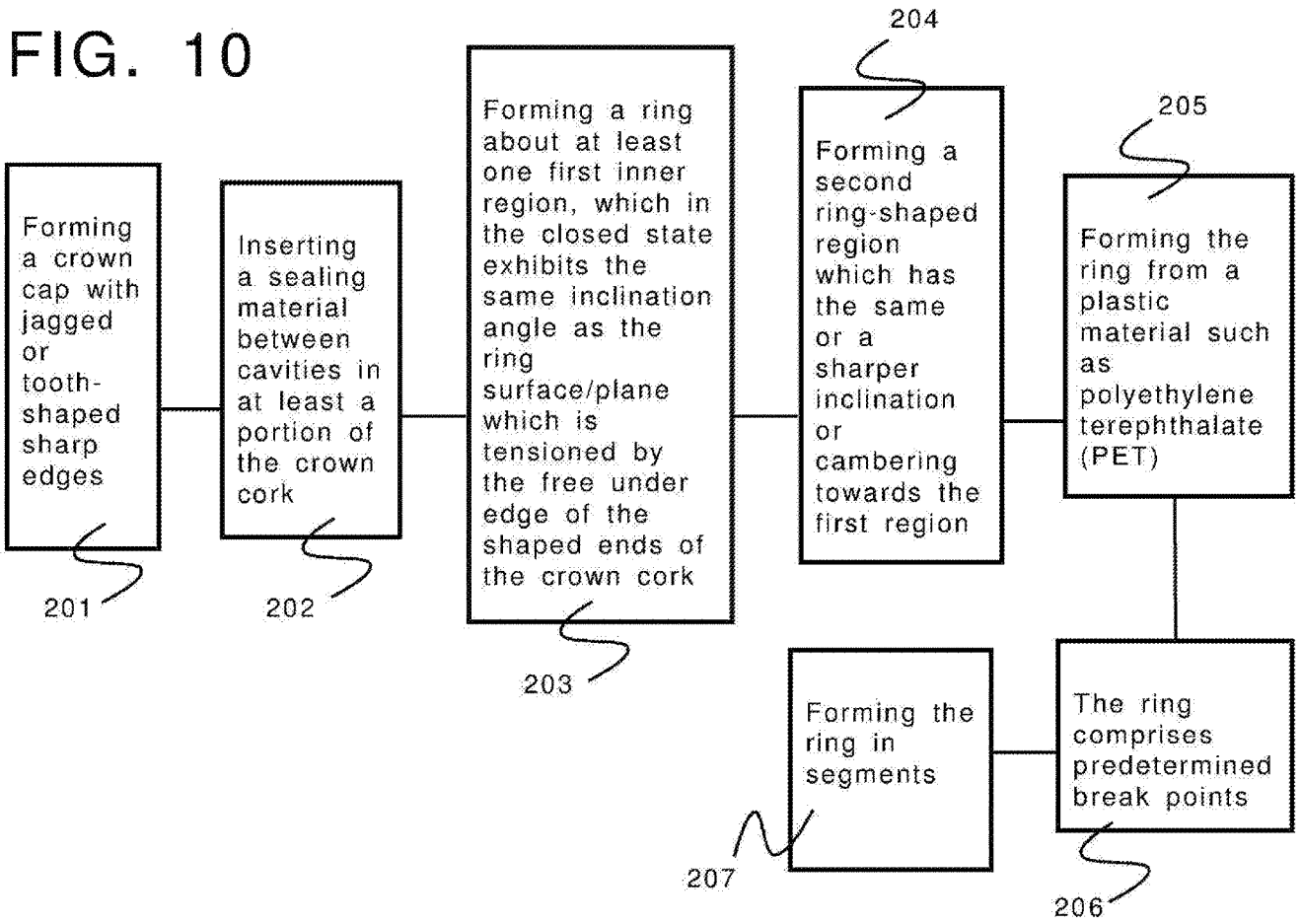
FIG. 10 is a block diagram of one possible exemplification of the method according to the present application.

FIG. 10 is a block diagram of one possible exemplification of the method according to the present application. One step in the method as shown in FIG. 10, shown by 201, includes forming a crown cap with jagged or tooth-shaped sharp edges. A following or subsequent step in the method as shown in FIG. 10, shown by 202, includes inserting a sealing material between cavities in at least a portion of the crown cork. A following or subsequent step in the method as shown in FIG. 10, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 10, shown by 204, includes forming a second ring-shaped region which has the same or a sharper inclination or cambering towards the first region. A following or subsequent step in the method as shown in FIG. 10, shown by 205, includes forming the ring from a plastic material such as polyethylene terephthalate (PET). A following or subsequent step in the method as shown in FIG. 10, shown by 206, includes the ring comprising predetermined break points. A following or subsequent step in the method as shown in FIG. 10, shown by 207, includes forming the ring in segments.

Figure 11:
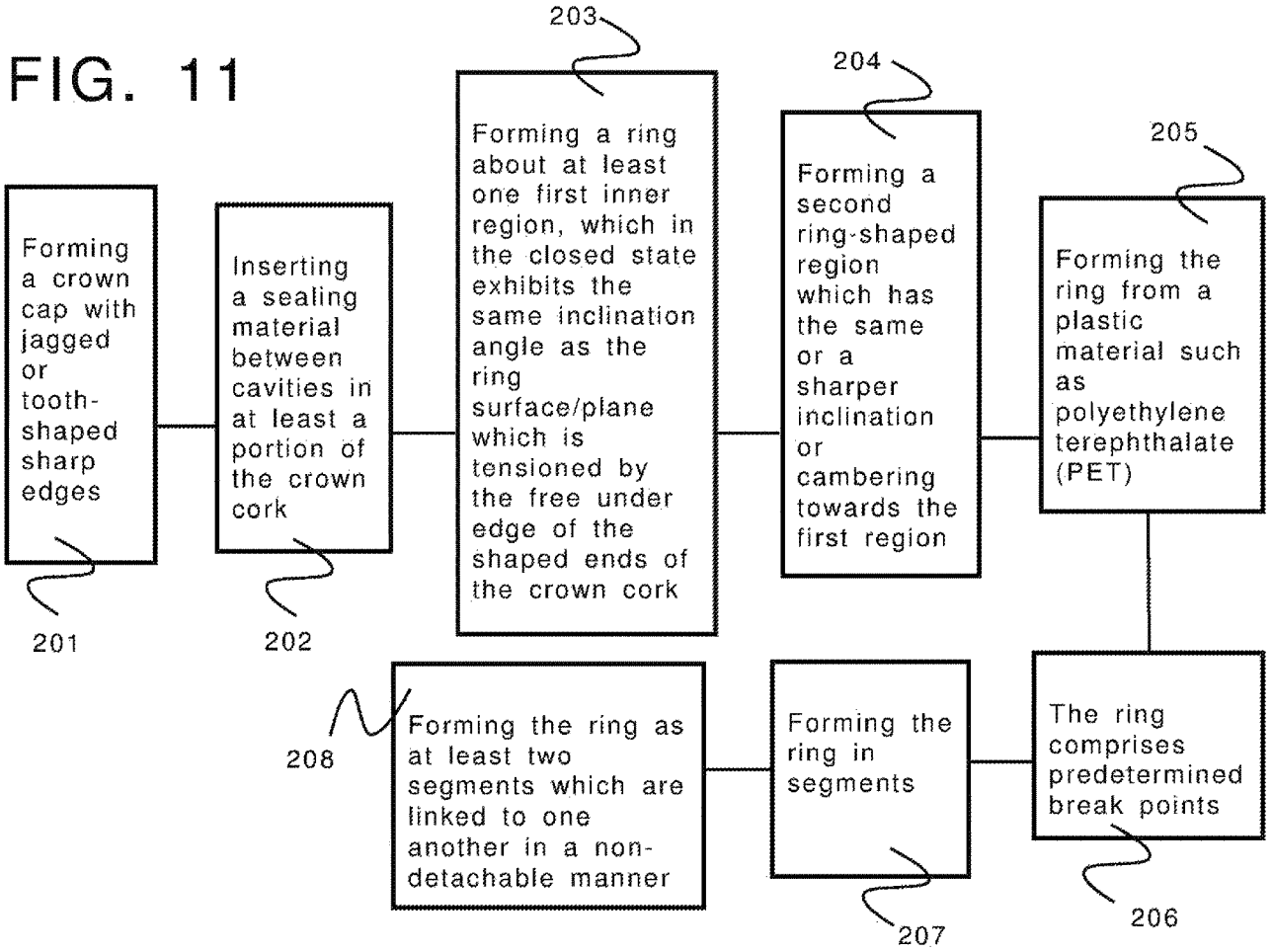
FIG. 11 is a block diagram of one possible exemplification of the method according to the present application.

FIG. 11 is a block diagram of one possible exemplification of the method according to the present application. One step in the method as shown in FIG. 11, shown by 201, includes forming a crown cap with jagged or tooth-shaped sharp edges. A following or subsequent step in the method as shown in FIG. 11, shown by 202, includes inserting a sealing material between cavities in at least a portion of the crown cork. A following or subsequent step in the method as shown in FIG. 11, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 11, shown by 204, includes forming a second ring-shaped region which has the same or a sharper inclination or cambering towards the first region. A following or subsequent step in the method as shown in FIG. 11, shown by 205, includes forming the ring from a plastic material such as polyethylene terephthalate (PET). A following or subsequent step in the method as shown in FIG. 11, shown by 206, includes the ring comprising predetermined break points. A following or subsequent step in the method as shown in FIG. 11, shown by 207, includes forming the ring in segments. A following or subsequent step in the method as shown in FIG. 11, shown by 208, includes forming the ring as at least two segments which are linked to one another in a non-detachable manner.

Figure 12A:
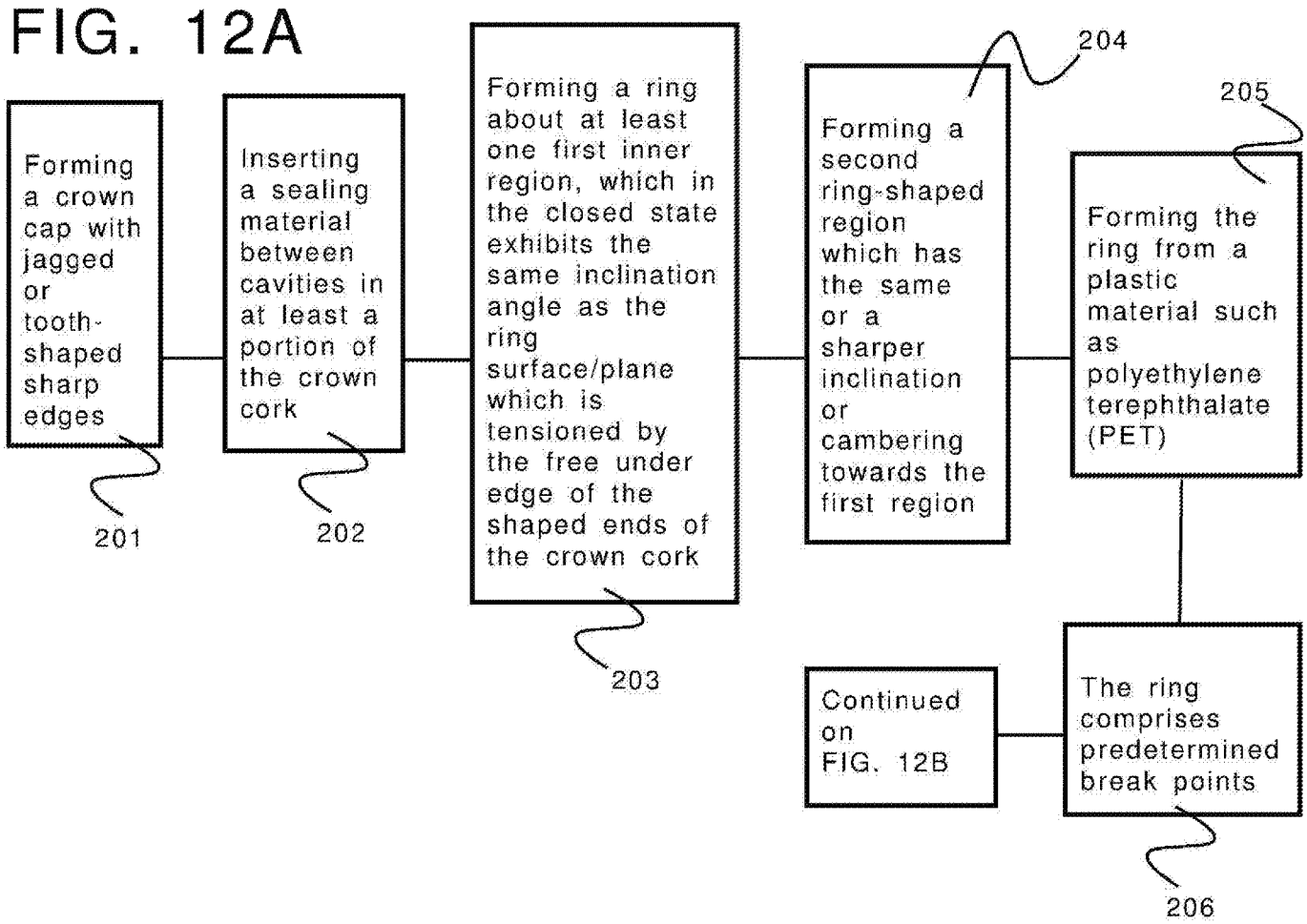
FIG. 12A is a block diagram of one portion of one possible exemplification of the method according to the present application.

FIG. 12A is a block diagram of one possible exemplification of the method according to the present application. One step in the method as shown in FIG. 12A, shown by 201, includes forming a crown cap with jagged or tooth-shaped sharp edges. A following or subsequent step in the method as shown in FIG. 12A, shown by 202, includes inserting a sealing material between cavities in at least a portion of the crown cork. A following or subsequent step in the method as shown in FIG. 12A, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 12A shown by 204, includes forming a second ring-shaped region which has the same or a sharper inclination or cambering towards the first region. A following or subsequent step in the method as shown in FIG. 12A, shown by 205, includes forming the ring from a plastic material such as polyethylene terephthalate (PET). A following or subsequent step in the method as shown in FIG. 12A, shown by 206, includes the ring comprising predetermined break points.

Figure 12B:
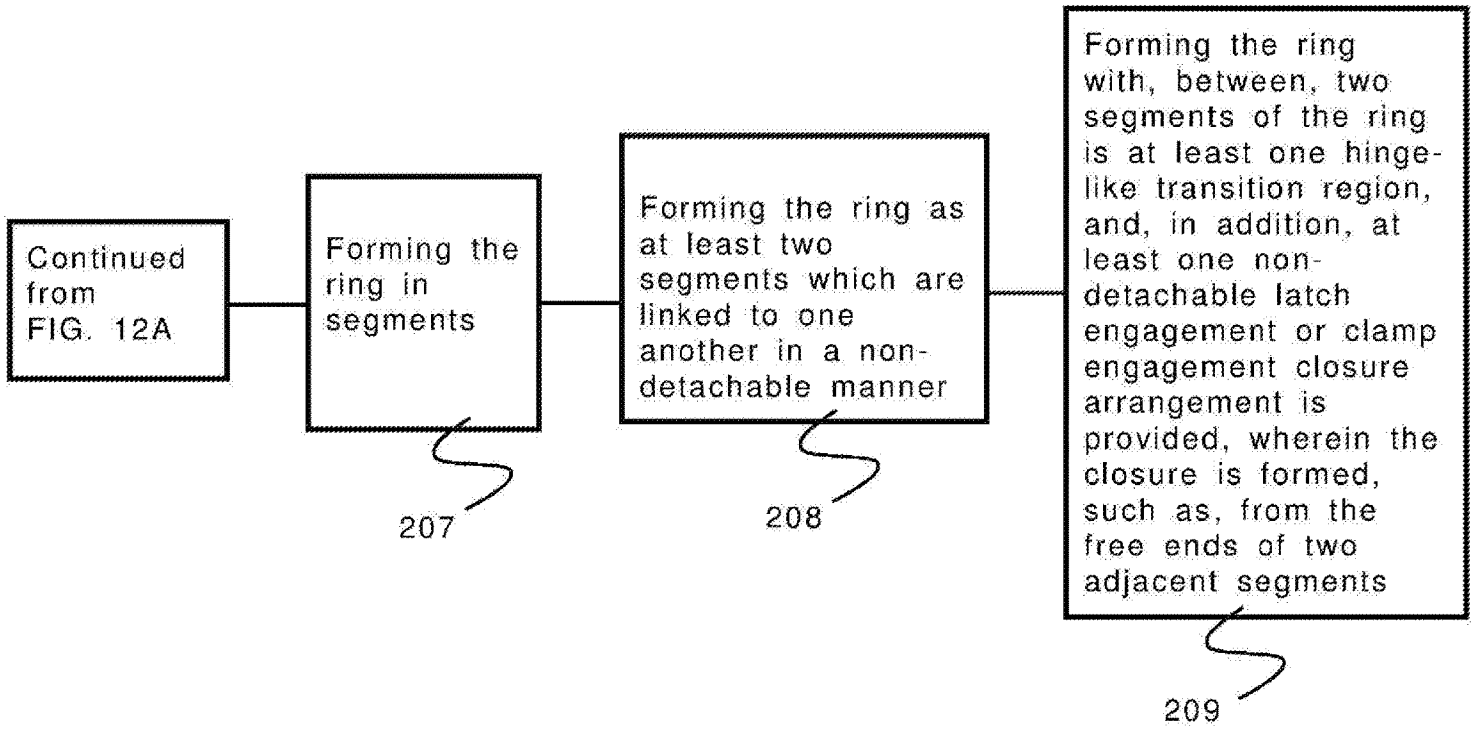
FIG. 12B is a block diagram of the other portion of the one possible exemplification of the method shown in FIG. 12A.

FIG. 12B shows the continuation of the method shown in FIG. 12A. A following or subsequent step in the method as shown in FIG. 12A, shown by 207, includes forming the ring in segments. A following or subsequent step in the method as shown in FIG. 12B, shown by 208, includes forming the ring as at least two segments which are linked to one another in a non-detachable manner. A following or subsequent step to the method as shown in FIG. 12B, shown by 209, includes forming the ring with, between, two segments of the ring is at least one hinge-like transition region, and, in addition, at least one non-detachable latch engagement or clamp engagement closure arrangement is provided, wherein the closure is formed, such as, from the free ends of two adjacent segments.

Figure 13:
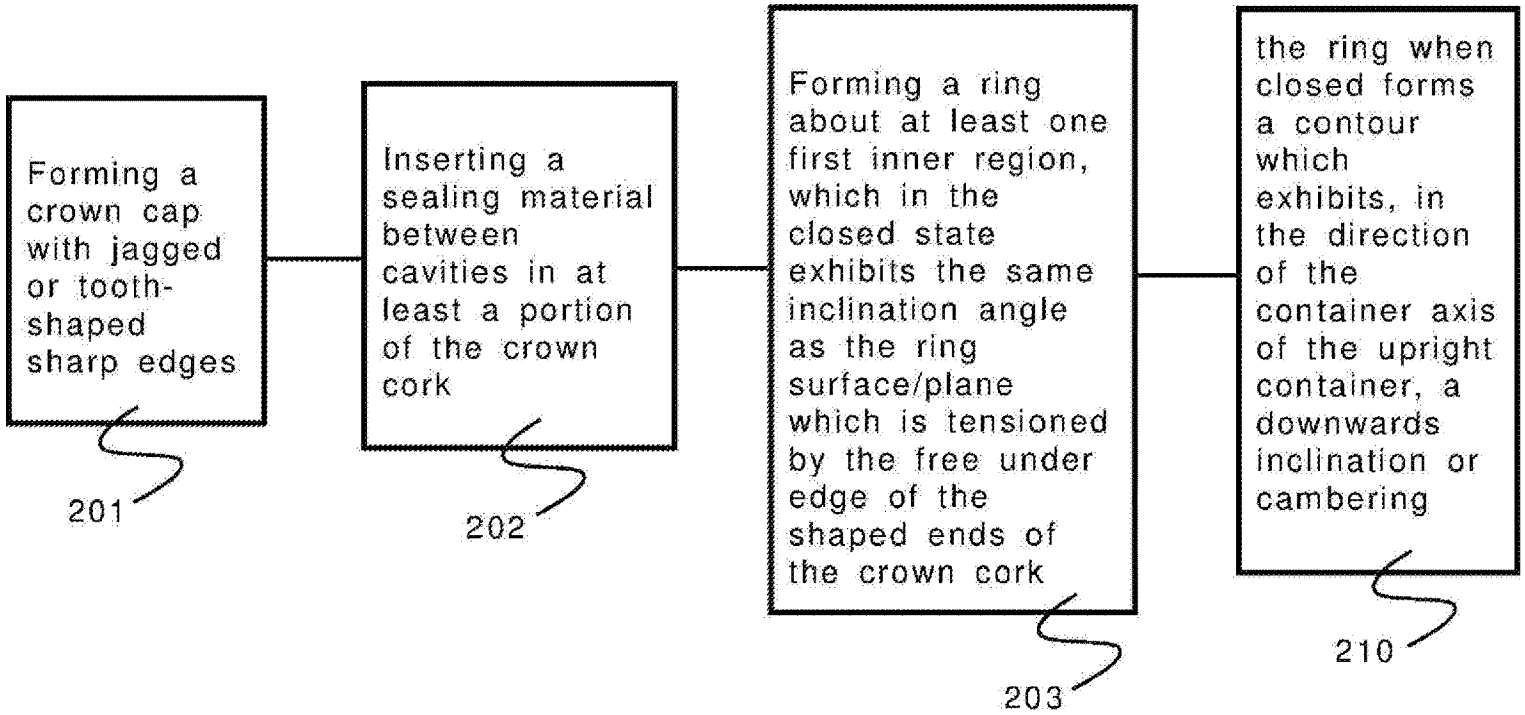
FIG. 13 is a block diagram of one possible exemplification of the method according to the present application.

FIG. 13 is a block diagram of one possible exemplification of the method according to the present application. One step in the method as shown in FIG. 13, shown by 201, includes forming a crown cap with jagged or tooth-shaped sharp edges. A following or subsequent step in the method as shown in FIG. 13, shown by 202, includes inserting a sealing material between cavities in at least a portion of the crown cork. A following or subsequent step in the method as shown in FIG. 13, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 13, shown by 210, includes the ring, when closed, forming a contour which exhibits, in the direction of the container axis of the upright container, a downwards inclination or cambering.

Figure 14:
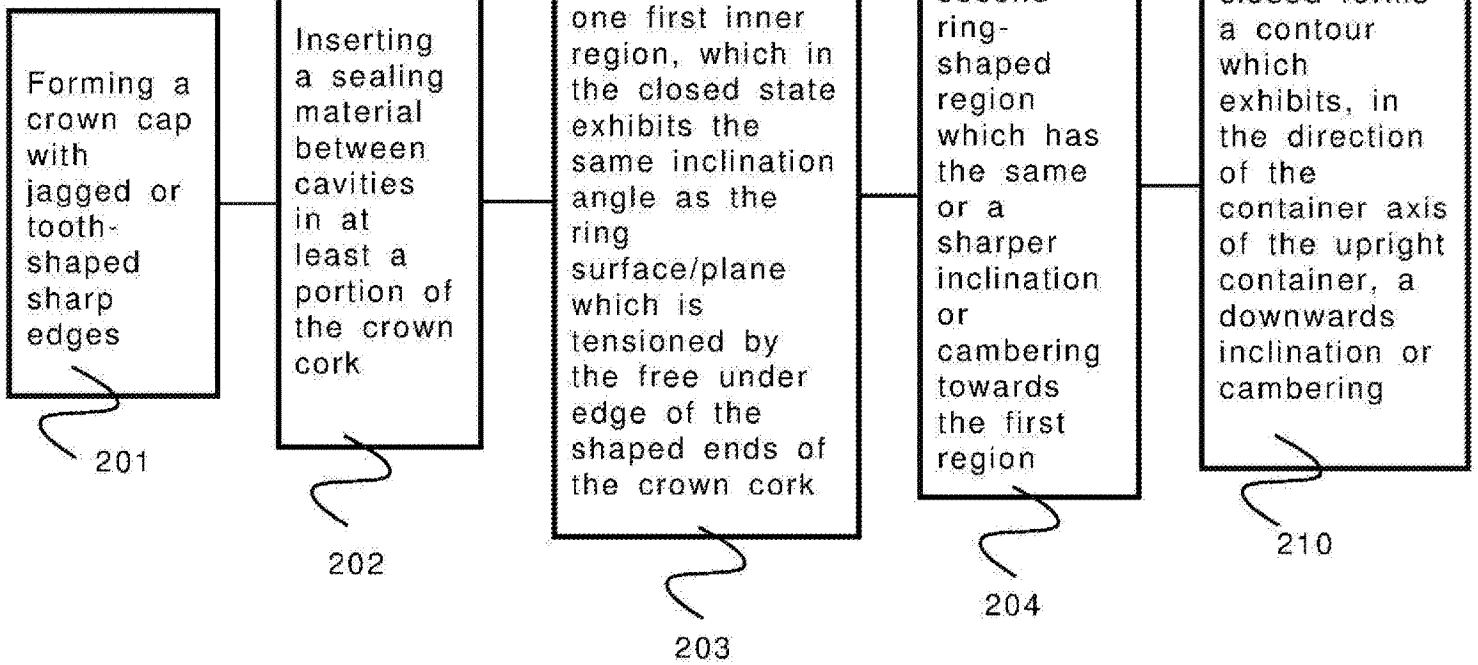
FIG. 14 is a block diagram of one possible exemplification of the method according to the present application.

FIG. 14 is a block diagram of one possible exemplification of the method according to the present application. One step in the method as shown in FIG. 14, shown by 201, includes forming a crown cap with jagged or tooth-shaped sharp edges. A following or subsequent step in the method as shown in FIG. 14, shown by 202, includes inserting a sealing material between cavities in at least a portion of the crown cork. A following or subsequent step in the method as shown in FIG. 14, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 14, shown by 204, includes forming a second ring-shaped region which has the same or a sharper inclination or cambering towards the first region. A following or subsequent step in the method as shown in FIG. 14, shown by 210, includes the ring, when closed, forming a contour which exhibits, in the direction of the container axis of the upright container, a downwards inclination or cambering.

Figure 15:
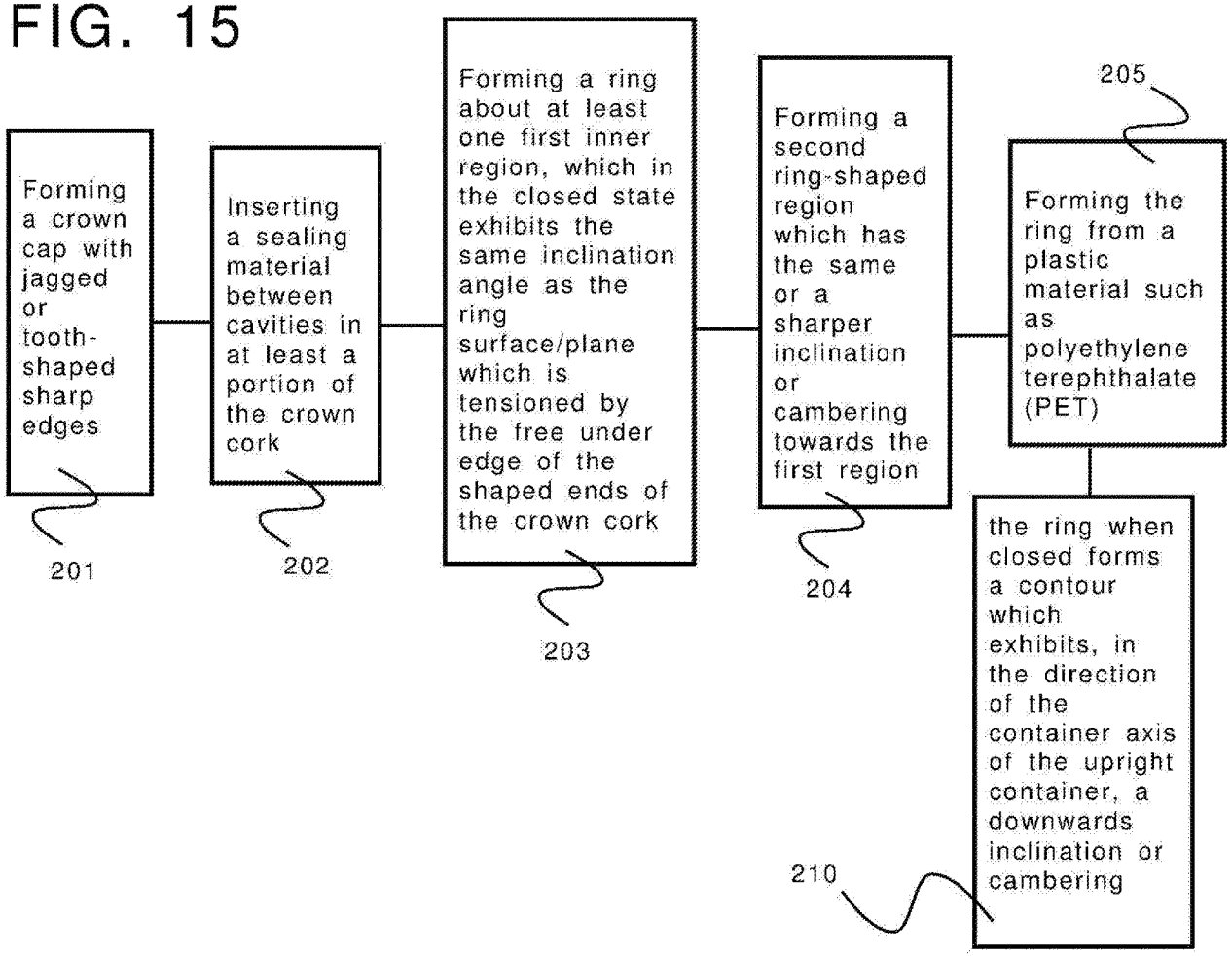
FIG. 15 is a block diagram of one possible exemplification of the method according to the present application.

FIG. 15 is a block diagram of one possible exemplification of the method according to the present application. One step in the method as shown in FIG. 15, shown by 201, includes forming a crown cap with jagged or tooth-shaped sharp edges. A following or subsequent step in the method as shown in FIG. 15, shown by 202, includes inserting a sealing material between cavities in at least a portion of the crown cork. A following or subsequent step in the method as shown in FIG. 15, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 15, shown by 204, includes forming a second ring-shaped region which has the same or a sharper inclination or cambering towards the first region. A following or subsequent step in the method as shown in FIG. 15, shown by 205, includes forming the ring from a plastic material such as polyethylene terephthalate (PET). A following or subsequent step in the method as shown in FIG. 15, shown by 210, includes the ring, when closed, forming a contour which exhibits, in the direction of the container axis of the upright container, a downwards inclination or cambering.

Figure 16:
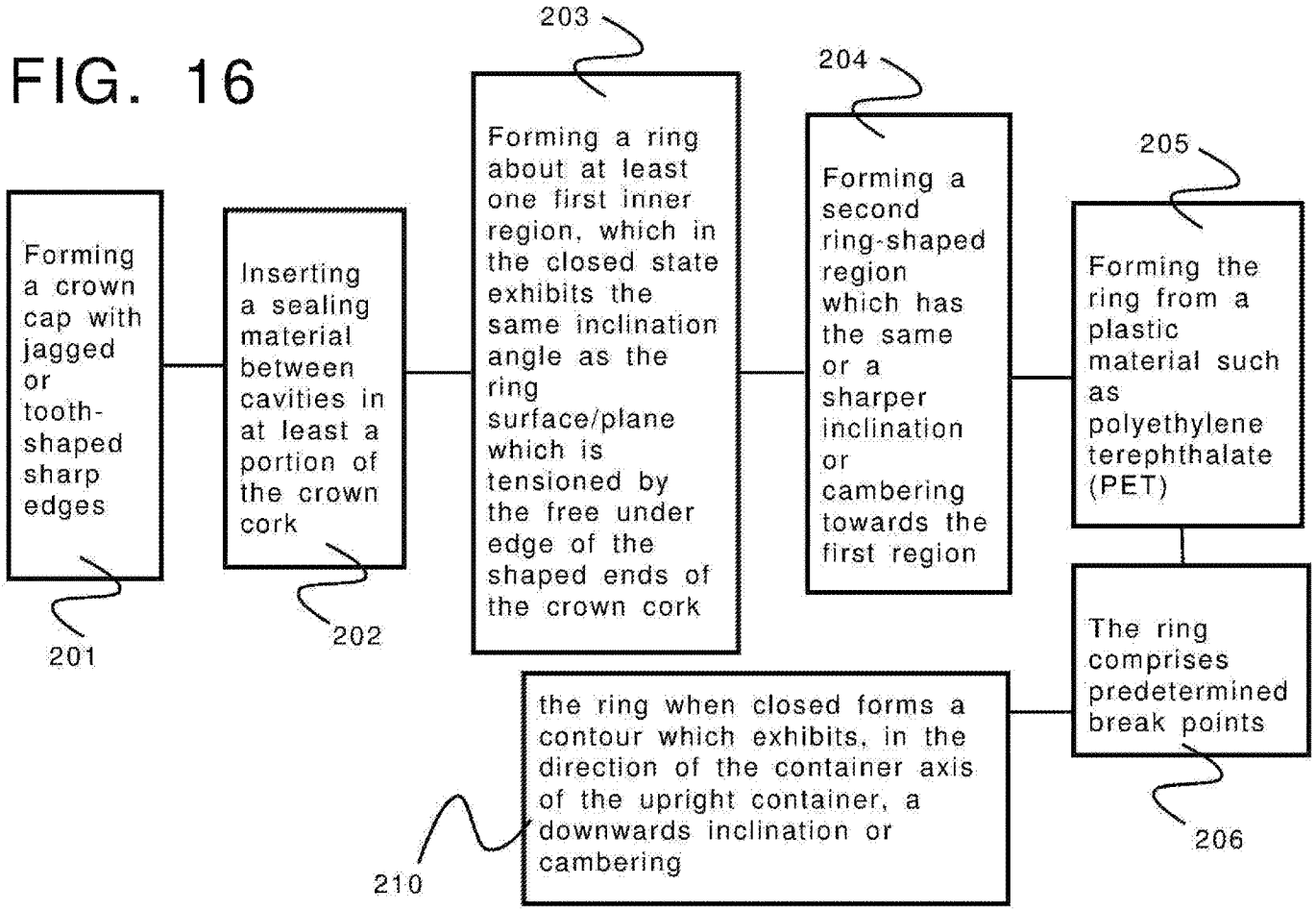
FIG. 16 is a block diagram of one possible exemplification of the method according to the present application.

FIG. 16 is a block diagram of one possible exemplification of the method according to the present application. One step in the method as shown in FIG. 16, shown by 201, includes forming a crown cap with jagged or tooth-shaped sharp edges. A following or subsequent step in the method as shown in FIG. 16, shown by 202, includes inserting a sealing material between cavities in at least a portion of the crown cork. A following or subsequent step in the method as shown in FIG. 16, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 16, shown by 204, includes forming a second ring-shaped region which has the same or a sharper inclination or cambering towards the first region. A following or subsequent step in the method as shown in FIG. 16, shown by 205, includes forming the ring from a plastic material such as polyethylene terephthalate (PET). A following or subsequent step in the method as shown in FIG. 16, shown by 206, includes the ring comprising predetermined break points. A following or subsequent step in the method as shown in FIG. 16, shown by 210, includes the ring, when closed, forming a contour which exhibits, in the direction of the container axis of the upright container, a downwards inclination or cambering.

Figure 17:
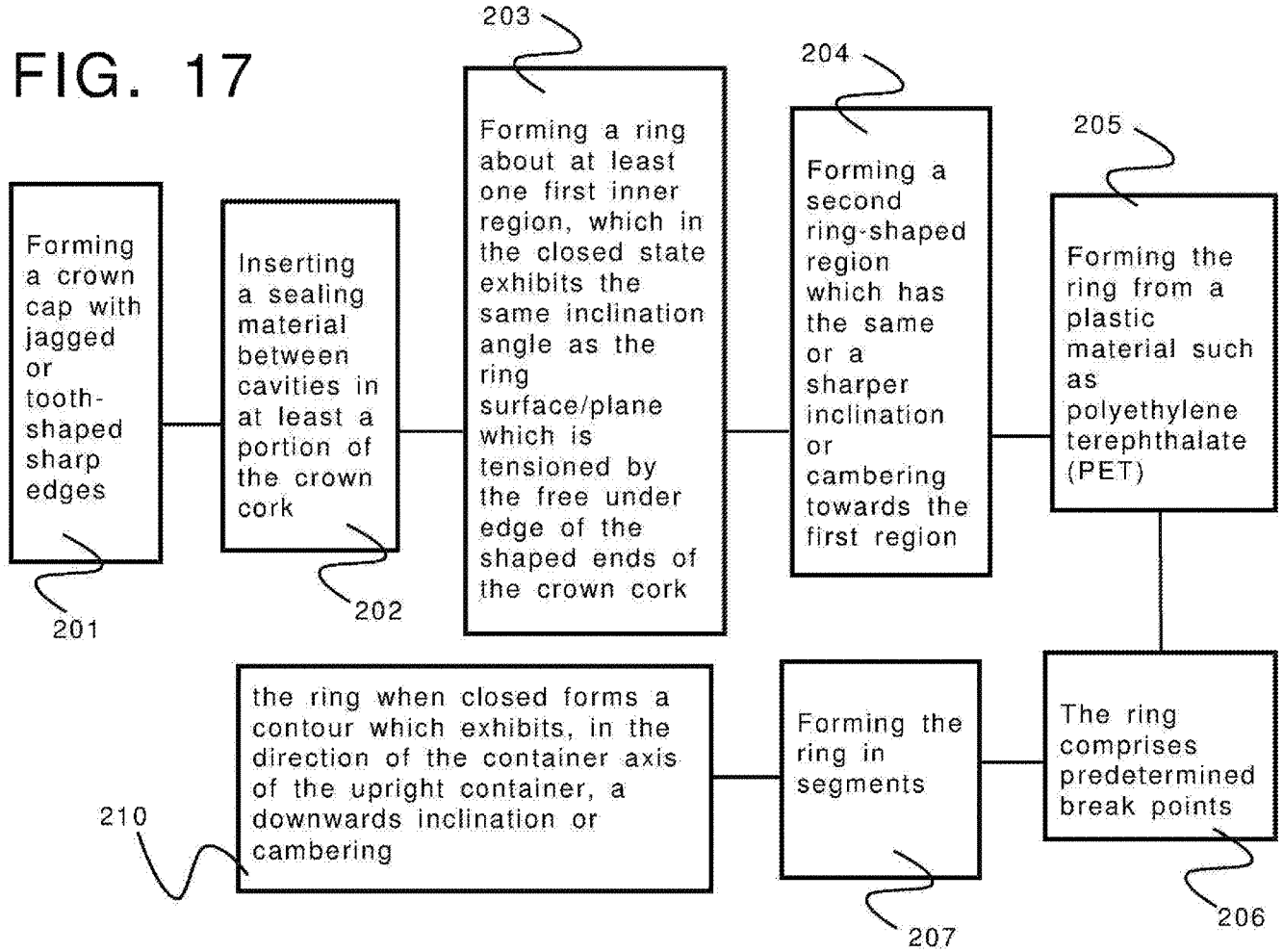
FIG. 17 is a block diagram of one possible exemplification of the method according to the present application.

FIG. 17 is a block diagram of one possible exemplification of the method according to the present application. One step in the method as shown in FIG. 17, shown by 201, includes forming a crown cap with jagged or tooth-shaped sharp edges. A following or subsequent step in the method as shown in FIG. 17, shown by 202, includes inserting a sealing material between cavities in at least a portion of the crown cork. A following or subsequent step in the method as shown in FIG. 17, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 17, shown by 204, includes forming a second ring-shaped region which has the same or a sharper inclination or cambering towards the first region. A following or subsequent step in the method as shown in FIG. 17, shown by 205, includes forming the ring from a plastic material such as polyethylene terephthalate (PET). A following or subsequent step in the method as shown in FIG. 17, shown by 206, includes the ring comprising predetermined break points. A following or subsequent step in the method as shown in FIG. 17, shown by 207, includes forming the ring in segments. A following or subsequent step in the method as shown in FIG. 17, shown by 210, includes the ring, when closed, forming a contour which exhibits, in the direction of the container axis of the upright container, a downwards inclination or cambering.

Figure 18:
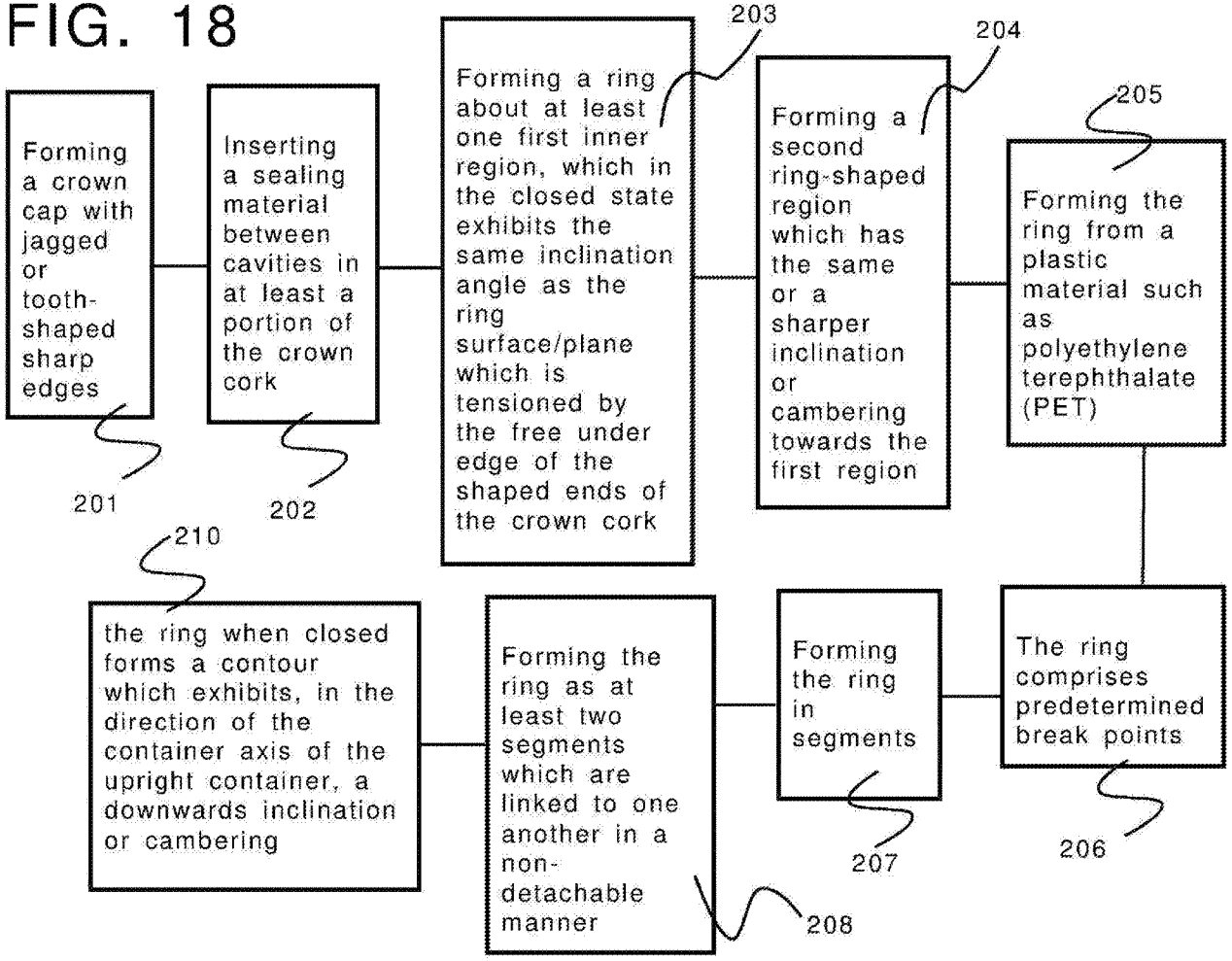
FIG. 18 is a block diagram of one possible exemplification of the method according to the present application.

FIG. 18 is a block diagram of one possible exemplification of the method according to the present application. One step in the method as shown in FIG. 18, shown by 201, includes forming a crown cap with jagged or tooth-shaped sharp edges. A following or subsequent step in the method as shown in FIG. 18, shown by 202, includes inserting a sealing material between cavities in at least a portion of the crown cork. A following or subsequent step in the method as shown in FIG. 18, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 18, shown by 204, includes forming a second ring-shaped region which has the same or a sharper inclination or cambering towards the first region. A following or subsequent step in the method as shown in FIG. 18, shown by 205, includes forming the ring from a plastic material such as polyethylene terephthalate (PET). A following or subsequent step in the method as shown in FIG. 18, shown by 206, includes the ring comprising predetermined break points. A following or subsequent step in the method as shown in FIG. 18, shown by 207, includes forming the ring in segments. A following or subsequent step in the method as shown in FIG. 18, shown by 208, includes forming the ring as at least two segments which are linked to one another in a non-detachable manner. A following or subsequent step in the method as shown in FIG. 18, shown by 210, includes the ring, when closed, forming a contour which exhibits, in the direction of the container axis of the upright container, a downwards inclination or cambering.

Figure 19:
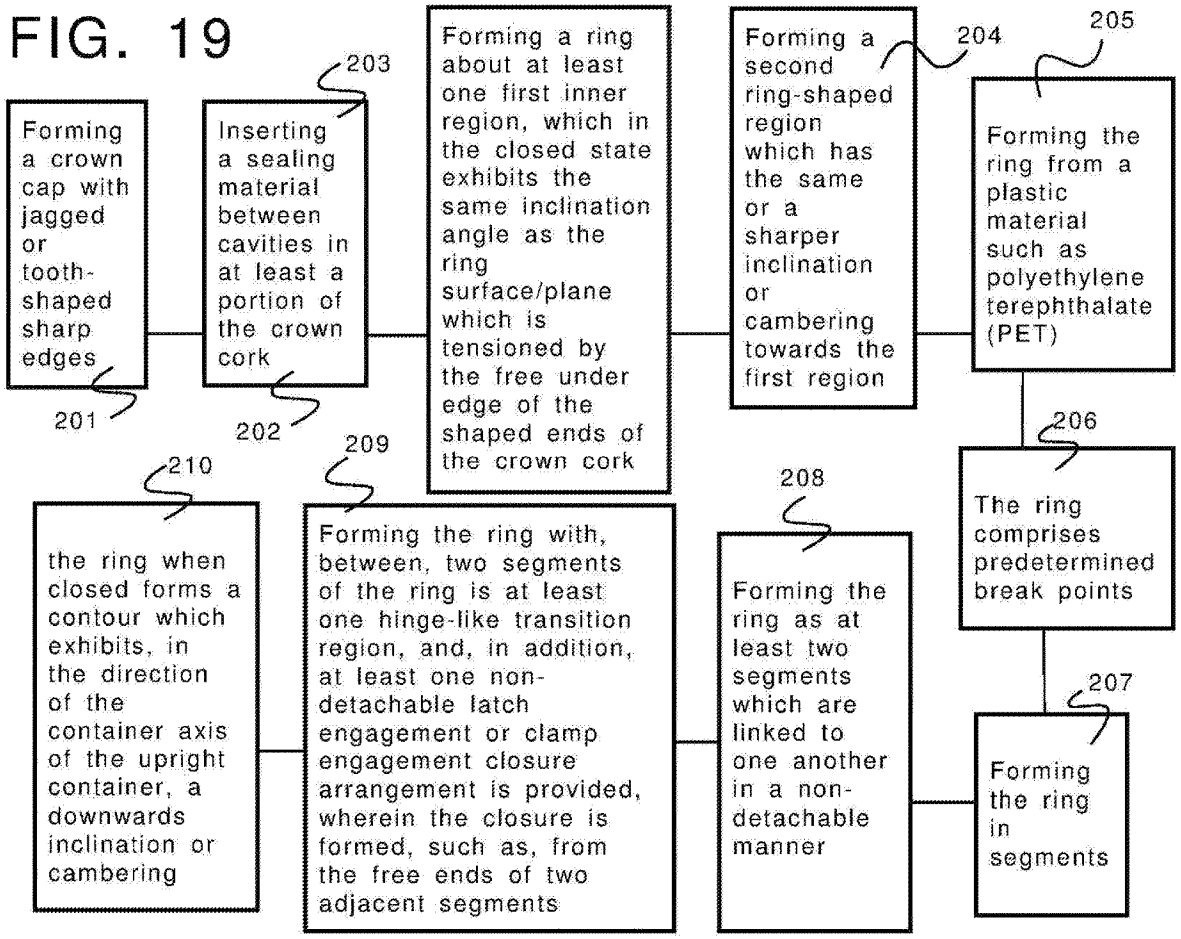
FIG. 19 is a block diagram of one possible exemplification of the method according to the present application.

FIG. 19 is a block diagram of one possible exemplification of the method according to the present application. One step in the method as shown in FIG. 19, shown by 201, includes forming a crown cap with jagged or tooth-shaped sharp edges. A following or subsequent step in the method as shown in FIG. 19, shown by 202, includes inserting a sealing material between cavities in at least a portion of the crown cork. A following or subsequent step in the method as shown in FIG. 19, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 19 shown by 204, includes forming a second ring-shaped region which has the same or a sharper inclination or cambering towards the first region. A following or subsequent step in the method as shown in FIG. 19, shown by 205, includes forming the ring from a plastic material such as polyethylene terephthalate (PET). A following or subsequent step in the method as shown in FIG. 19, shown by 206, includes the ring comprising predetermined break points. A following or subsequent step in the method as shown in FIG. 19, shown by 207, includes forming the ring in segments. A following or subsequent step in the method as shown in FIG. 19, shown by 208, includes forming the ring as at least two segments which are linked to one another in a non-detachable manner. A following or subsequent step to the method as shown in FIG. 19, shown by 209, includes forming the ring with, between, two segments of the ring is at least one hinge-like transition region, and, in addition, at least one non-detachable latch engagement or clamp engagement closure arrangement is provided, wherein the closure is formed, such as, from the free ends of two adjacent segments. A following or subsequent step in the method as shown in FIG. 19, shown by 210, includes the ring, when closed, forming a contour which exhibits, in the direction of the container axis of the upright container, a downwards inclination or cambering.

Figure 20:
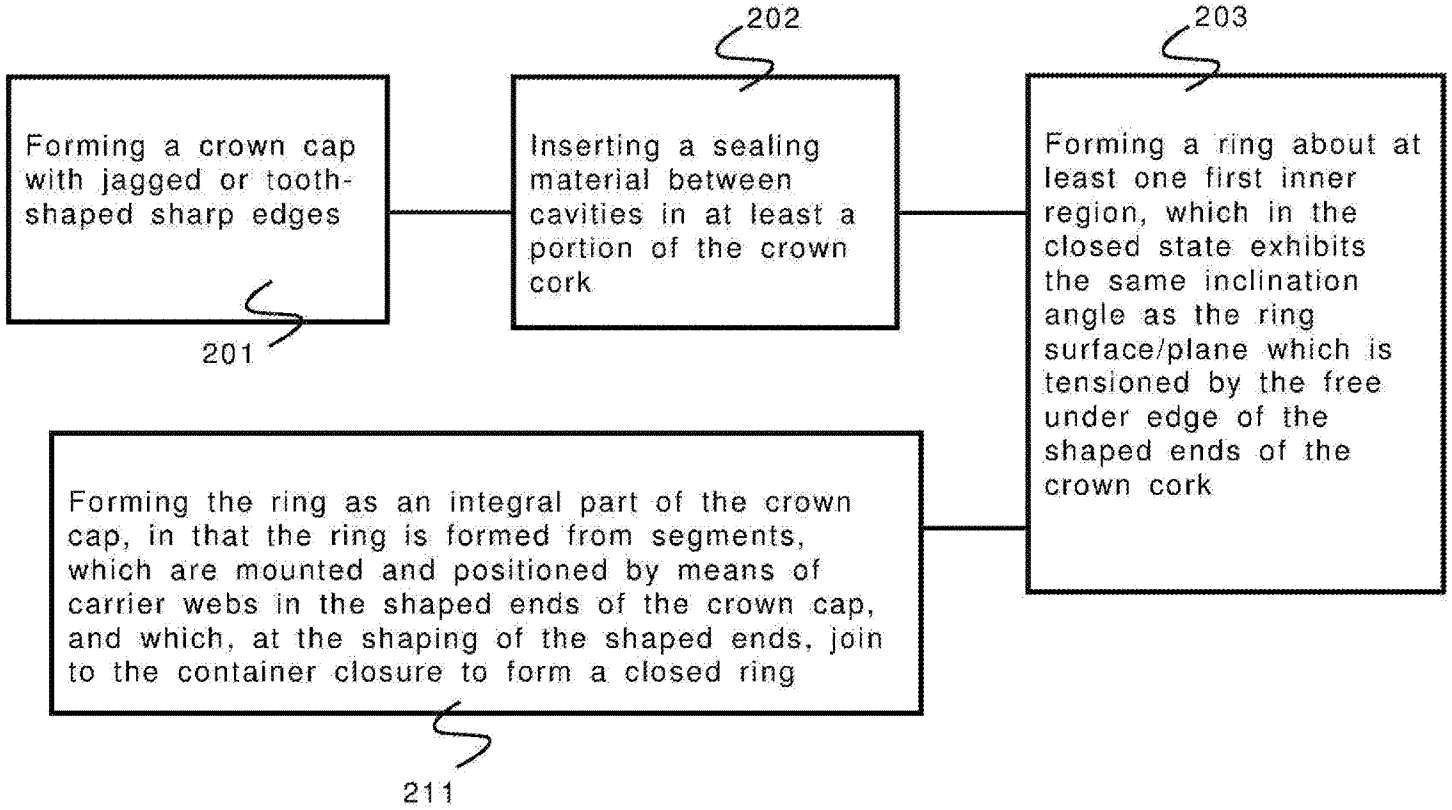
FIG. 20 is a block diagram of one possible exemplification of the method according to the present application.

FIG. 20 is a block diagram of one possible exemplification of the method according to the present application. One step in the method as shown in FIG. 20, shown by 201, includes forming a crown cap with jagged or tooth-shaped sharp edges. A following or subsequent step in the method as shown in FIG. 20, shown by 202, includes inserting a sealing material between cavities in at least a portion of the crown cork. A following or subsequent step in the method as shown in FIG. 20, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 20, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 21:
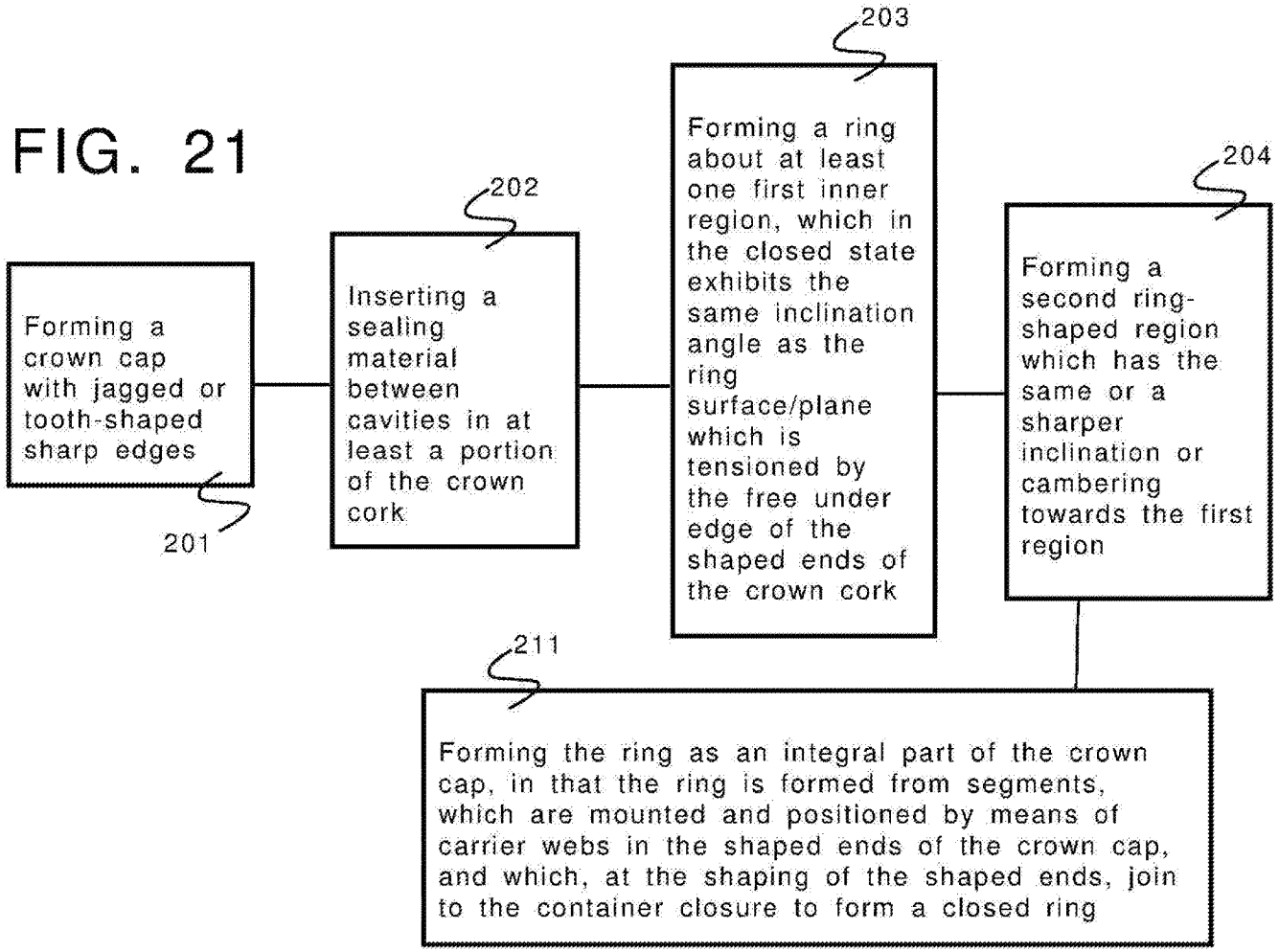
FIG. 21 is a block diagram of one possible exemplification of the method according to the present application.

FIG. 21 is a block diagram of one possible exemplification of the method according to the present application. One step in the method as shown in FIG. 21, shown by 201, includes forming a crown cap with jagged or tooth-shaped sharp edges. A following or subsequent step in the method as shown in FIG. 21, shown by 202, includes inserting a sealing material between cavities in at least a portion of the crown cork. A following or subsequent step in the method as shown in FIG. 21, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 21, shown by 204, includes forming a second ring-shaped region which has the same or a sharper inclination or cambering towards the first region. A following or subsequent step in the method as shown in FIG. 21, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 22:
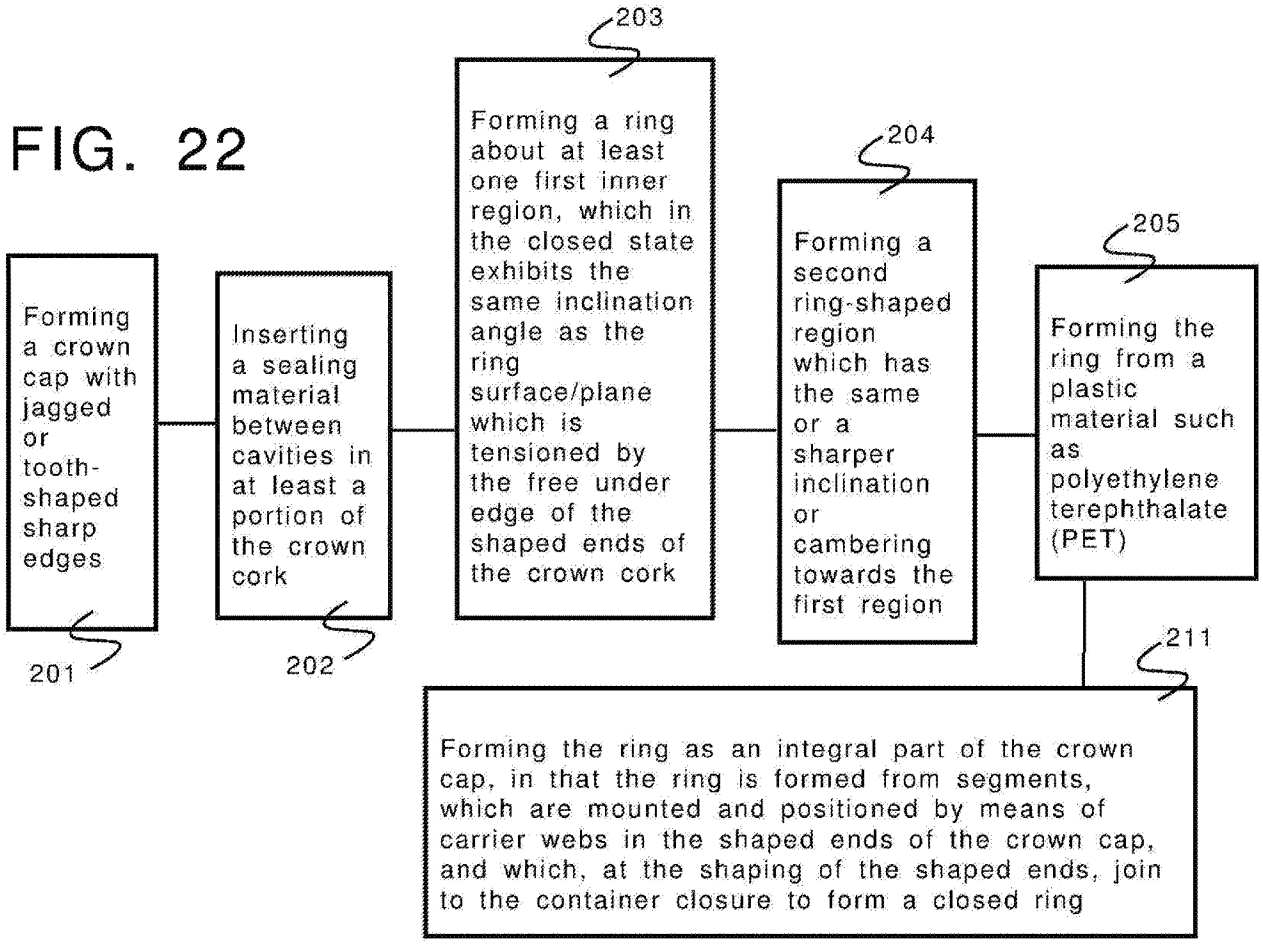
FIG. 22 is a block diagram of one possible exemplification of the method according to the present application.

FIG. 22 is a block diagram of one possible exemplification of the method according to the present application. One step in the method as shown in FIG. 22, shown by 201, includes forming a crown cap with jagged or tooth-shaped sharp edges. A following or subsequent step in the method as shown in FIG. 22, shown by 202, includes inserting a sealing material between cavities in at least a portion of the crown cork. A following or subsequent step in the method as shown in FIG. 22, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 22, shown by 204, includes forming a second ring-shaped region which has the same or a sharper inclination or cambering towards the first region. A following or subsequent step in the method as shown in FIG. 22, shown by 205, includes forming the ring from a plastic material such as polyethylene terephthalate (PET). A following or subsequent step in the method as shown in FIG. 22, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 23:
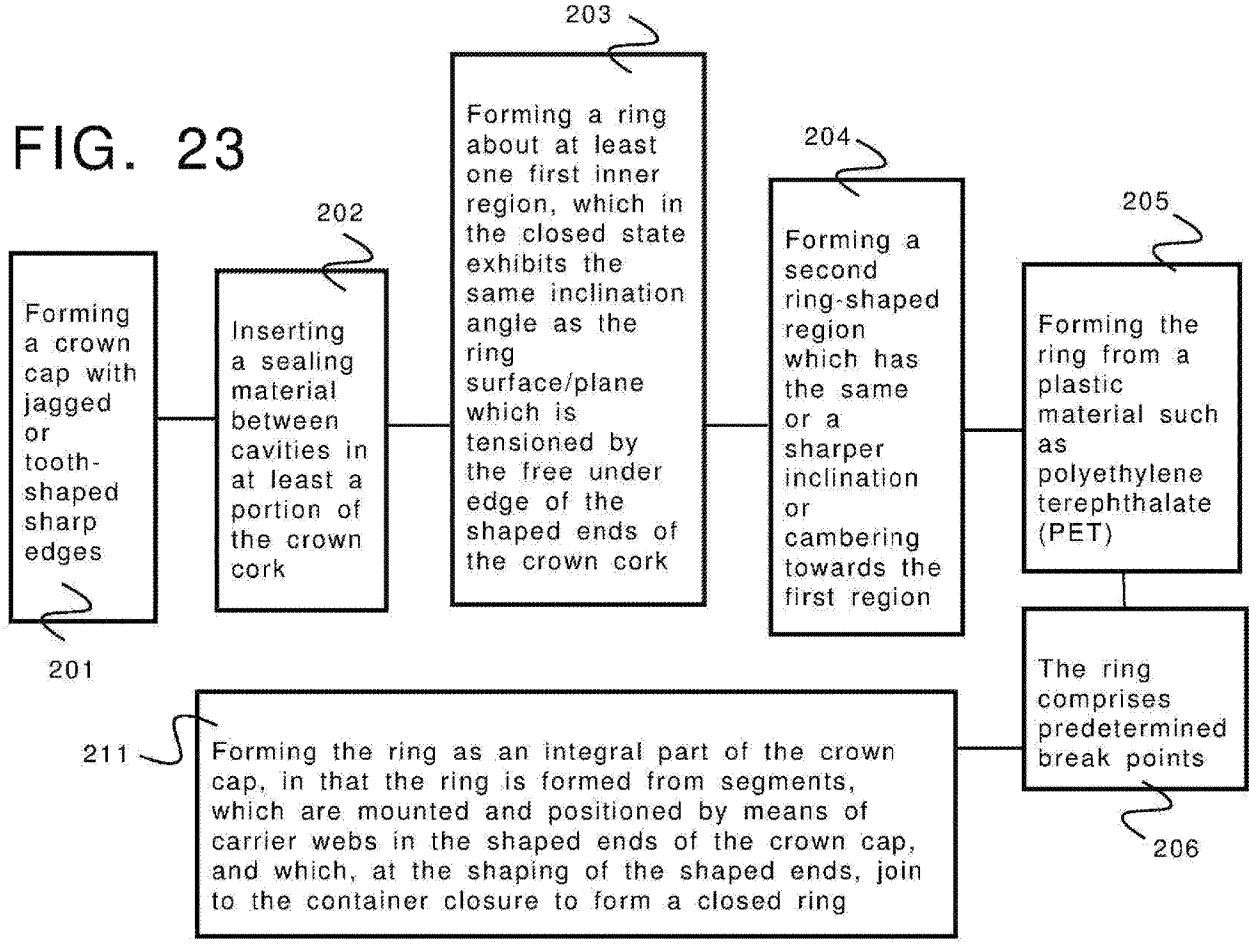
FIG. 23 is a block diagram of one possible exemplification of the method according to the present application.

FIG. 23 is a block diagram of one possible exemplification of the method according to the present application. One step in the method as shown in FIG. 23, shown by 201, includes forming a crown cap with jagged or tooth-shaped sharp edges. A following or subsequent step in the method as shown in FIG. 23, shown by 202, includes inserting a sealing material between cavities in at least a portion of the crown cork. A following or subsequent step in the method as shown in FIG. 23, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 23, shown by 204, includes forming a second ring-shaped region which has the same or a sharper inclination or cambering towards the first region. A following or subsequent step in the method as shown in FIG. 23, shown by 205, includes forming the ring from a plastic material such as polyethylene terephthalate (PET). A following or subsequent step in the method as shown in FIG. 23, shown by 206, includes the ring comprising predetermined break points. A following or subsequent step in the method as shown in FIG. 23, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 24:
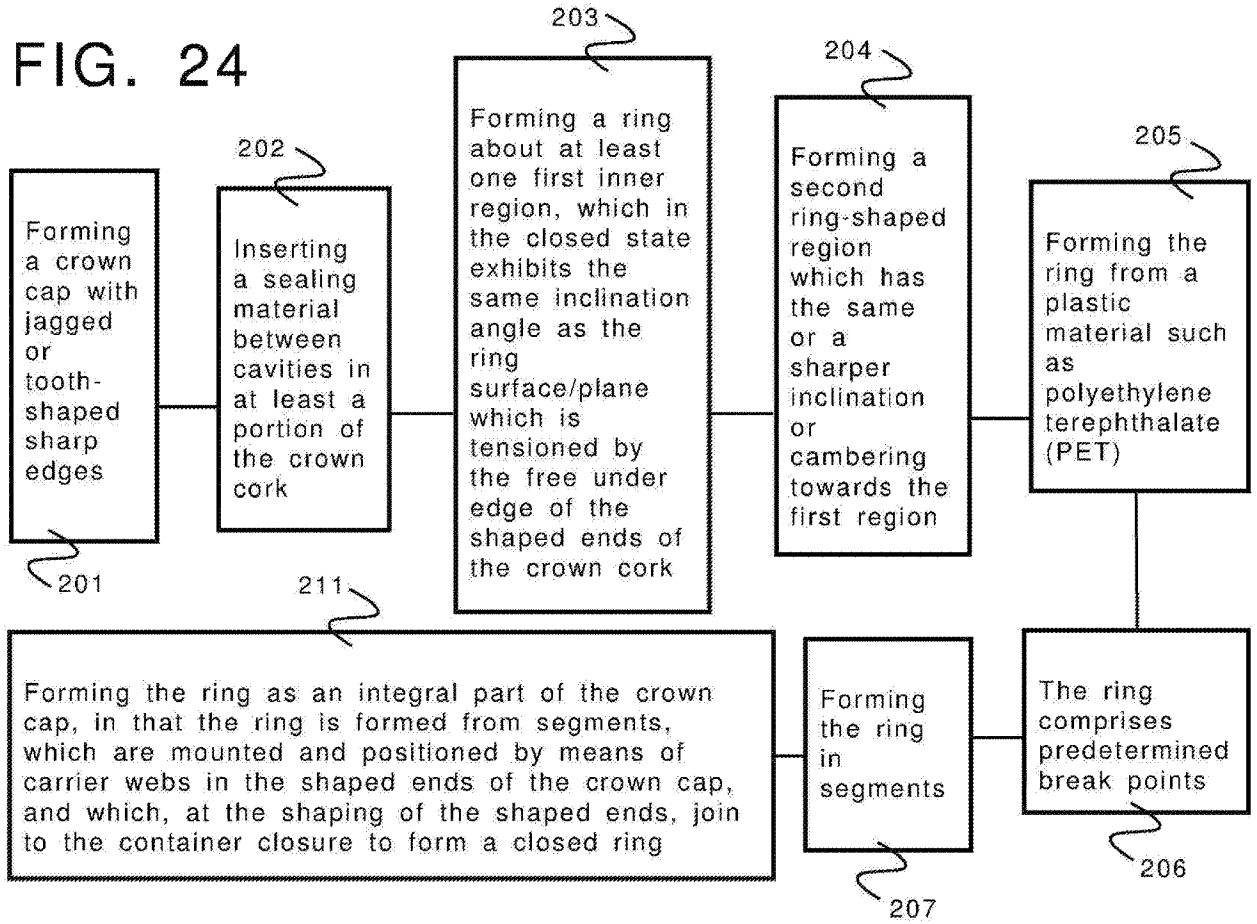
FIG. 24 is a block diagram of one possible exemplification of the method according to the present application.

FIG. 24 is a block diagram of one possible exemplification of the method according to the present application. One step in the method as shown in FIG. 24, shown by 201, includes forming a crown cap with jagged or tooth-shaped sharp edges. A following or subsequent step in the method as shown in FIG. 24, shown by 202, includes inserting a sealing material between cavities in at least a portion of the crown cork. A following or subsequent step in the method as shown in FIG. 24, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 24, shown by 204, includes forming a second ring-shaped region which has the same or a sharper inclination or cambering towards the first region. A following or subsequent step in the method as shown in FIG. 24, shown by 205, includes forming the ring from a plastic material such as polyethylene terephthalate (PET). A following or subsequent step in the method as shown in FIG. 24, shown by 206, includes the ring comprising predetermined break points. A following or subsequent step in the method as shown in FIG. 24, shown by 207, includes forming the ring in segments. A following or subsequent step in the method as shown in FIG. 24, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 25:
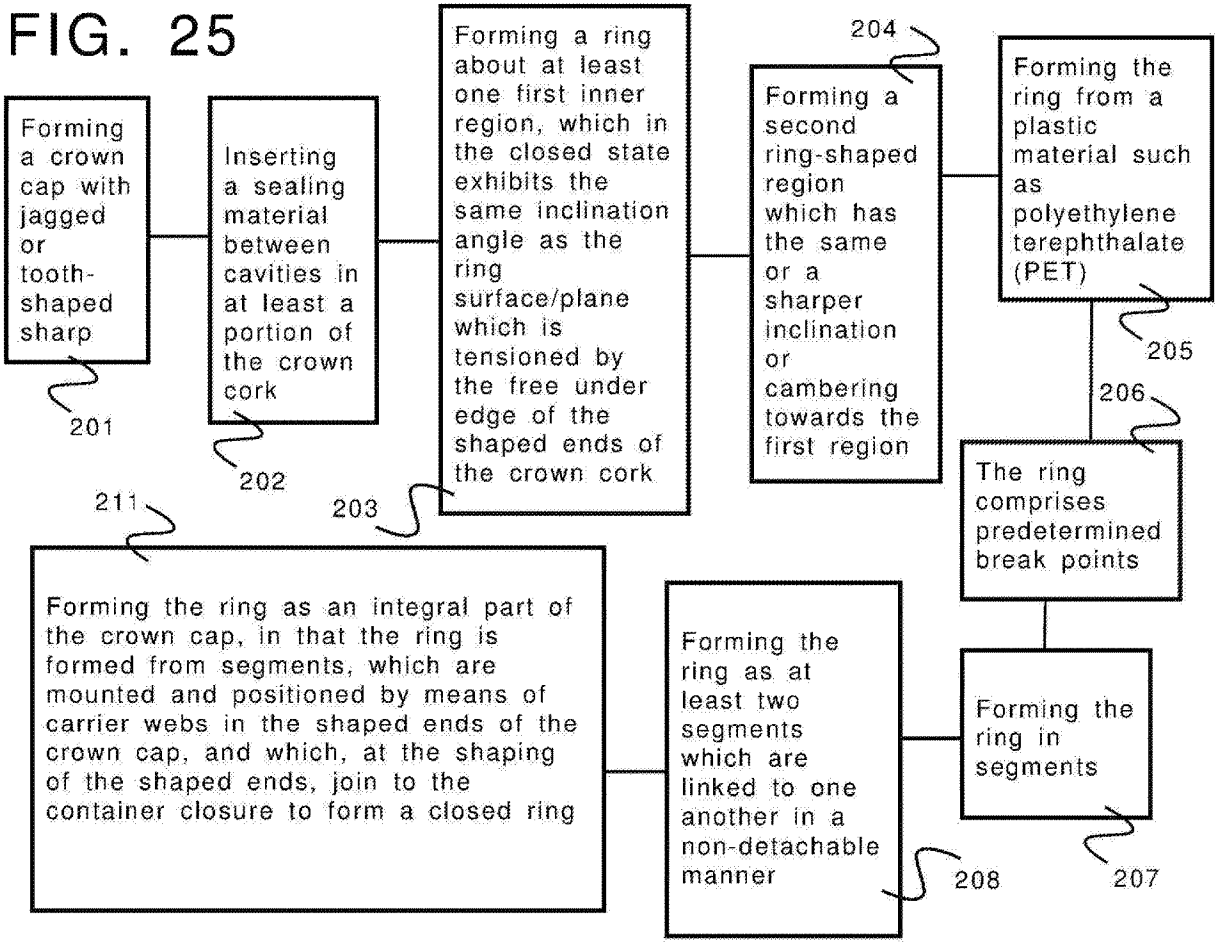
FIG. 25 is a block diagram of one possible exemplification of the method according to the present application.

FIG. 25 is a block diagram of one possible exemplification of the method according to the present application. One step in the method as shown in FIG. 25, shown by 201, includes forming a crown cap with jagged or tooth-shaped sharp edges. A following or subsequent step in the method as shown in FIG. 25, shown by 202, includes inserting a sealing material between cavities in at least a portion of the crown cork. A following or subsequent step in the method as shown in FIG. 25, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 25, shown by 204, includes forming a second ring-shaped region which has the same or a sharper inclination or cambering towards the first region. A following or subsequent step in the method as shown in FIG. 25, shown by 205, includes forming the ring from a plastic material such as polyethylene terephthalate (PET). A following or subsequent step in the method as shown in FIG. 25, shown by 206, includes the ring comprising predetermined break points. A following or subsequent step in the method as shown in FIG. 25, shown by 207, includes forming the ring in segments. A following or subsequent step in the method as shown in FIG. 25, shown by 208, includes forming the ring as at least two segments which are linked to one another in a non-detachable manner. A following or subsequent step in the method as shown in FIG. 25, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 26A:
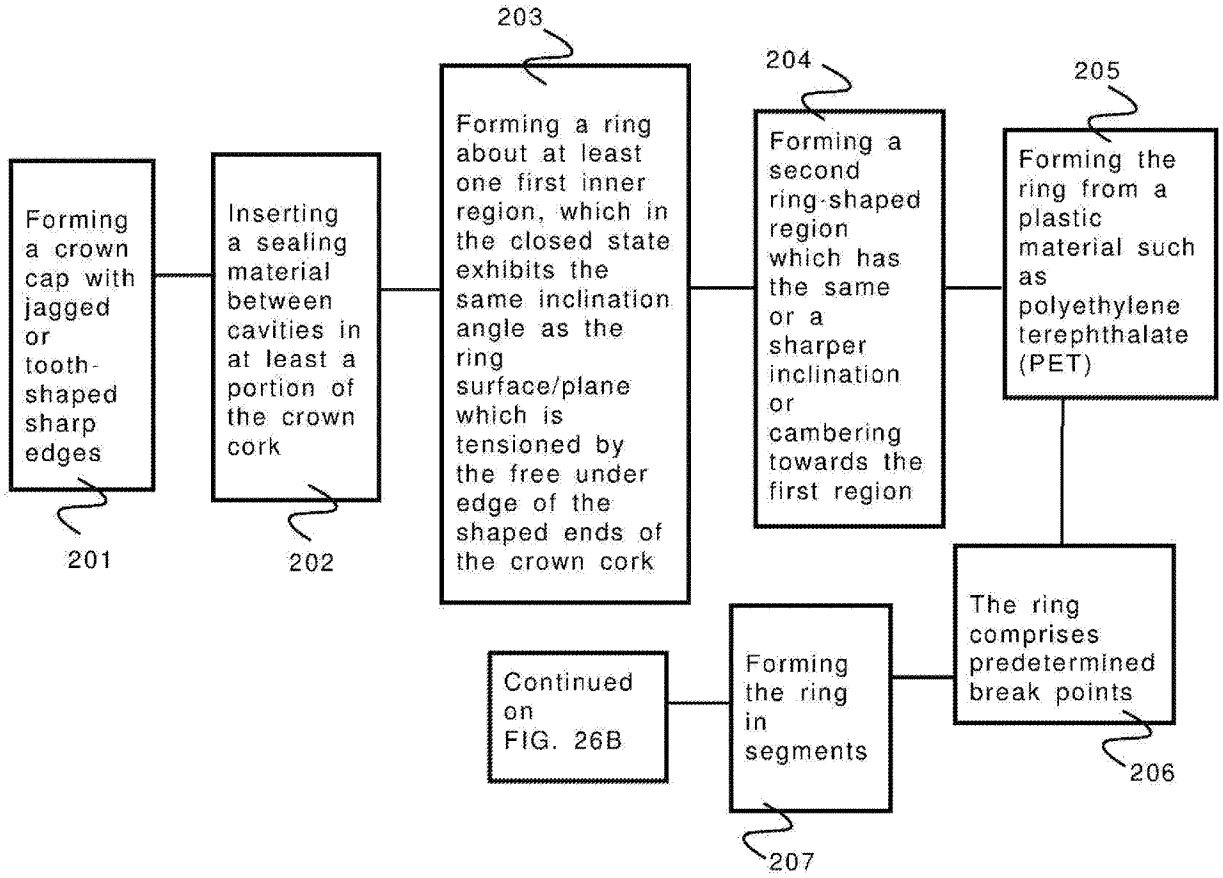
FIG. 26A is a block diagram of one portion of one possible exemplification of the method according to the present application.

FIG. 26A is a block diagram of one possible exemplification of the method according to the present application. One step in the method as shown in FIG. 26A, shown by 201, includes forming a crown cap with jagged or tooth-shaped sharp edges. A following or subsequent step in the method as shown in FIG. 26A, shown by 202, includes inserting a sealing material between cavities in at least a portion of the crown cork. A following or subsequent step in the method as shown in FIG. 26A, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 26A shown by 204, includes forming a second ring-shaped region which has the same or a sharper inclination or cambering towards the first region. A following or subsequent step in the method as shown in FIG. 26A, shown by 205, includes forming the ring from a plastic material such as polyethylene terephthalate (PET). A following or subsequent step in the method as shown in FIG. 26A, shown by 206, includes the ring comprising predetermined break points. A following or subsequent step in the method as shown in FIG. 26A, shown by 207, includes forming the ring in segments.

Figure 26B:
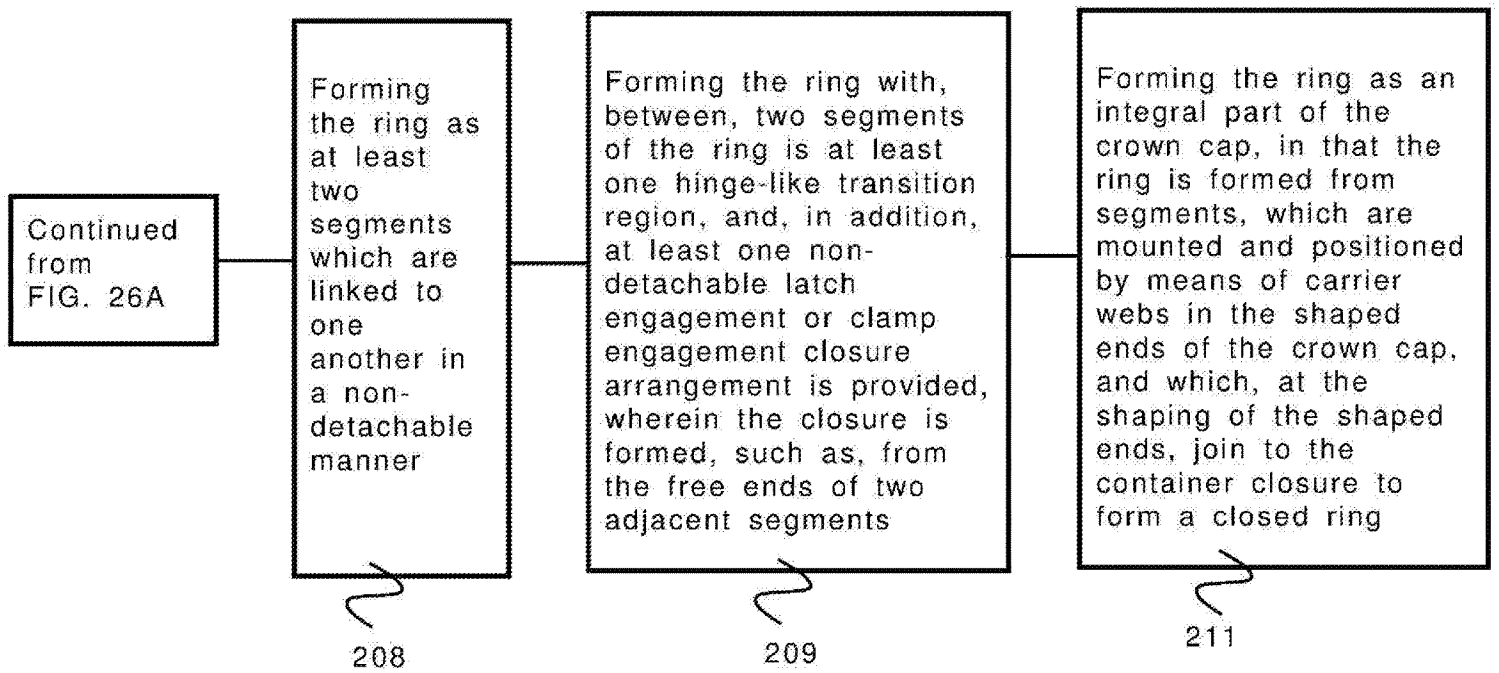
FIG. 26B is a block diagram of the other portion of the one possible exemplification of the method shown in FIG. 26A.

FIG. 26B shows the continuation of the method shown in FIG. 26A. A following or subsequent step in the method as shown in FIG. 26A, shown by 208, includes forming the ring as at least two segments which are linked to one another in a non-detachable manner. A following or subsequent step to the method as shown in FIG. 26B, shown by 209, includes forming the ring with, between, two segments of the ring is at least one hinge-like transition region, and, in addition, at least one non-detachable latch engagement or clamp engagement closure arrangement is provided, wherein the closure is formed, such as, from the free ends of two adjacent segments. A following or subsequent step in the method as shown in FIG. 26B, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 27:
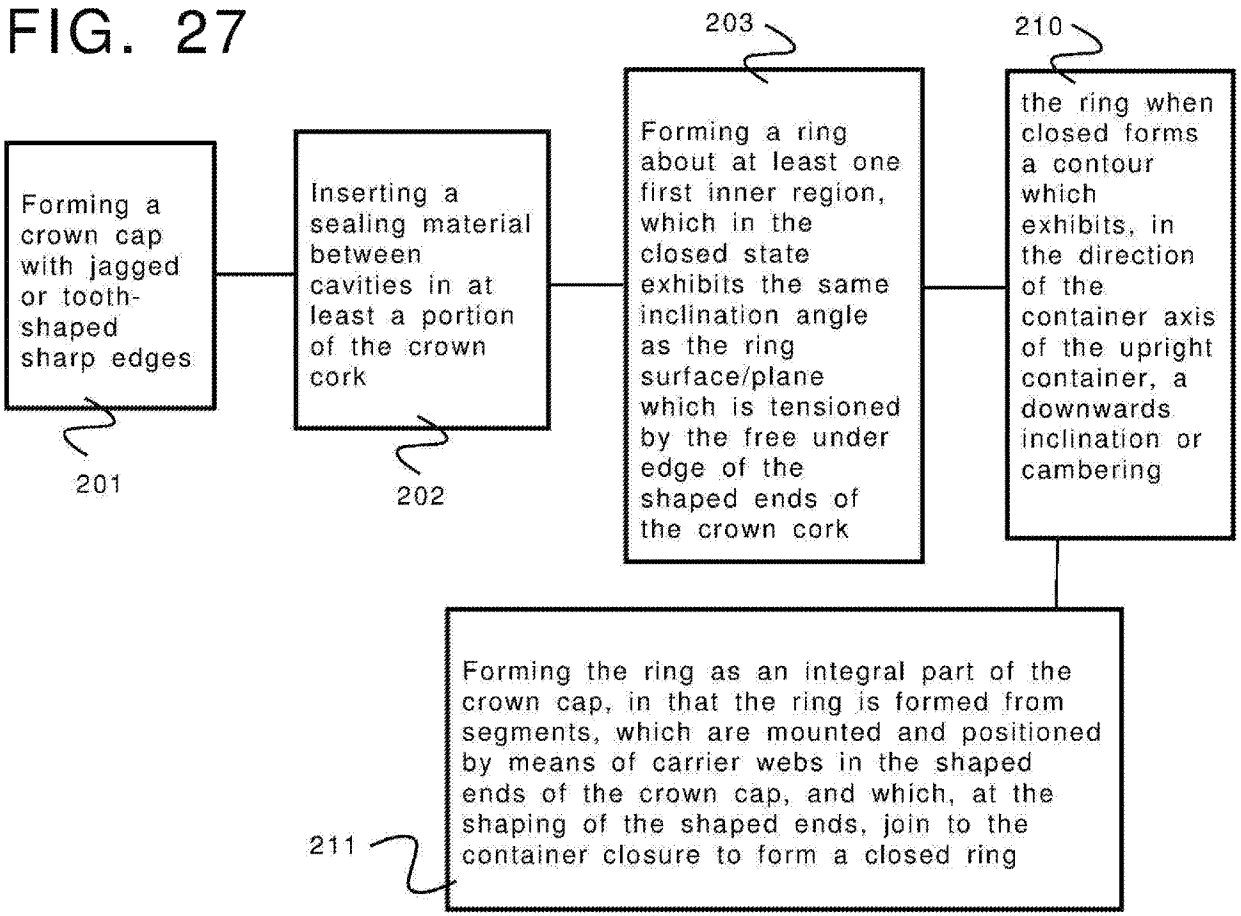
FIG. 27 is a block diagram of one possible exemplification of the method according to the present application.

FIG. 27 is a block diagram of one possible exemplification of the method according to the present application. One step in the method as shown in FIG. 27, shown by 201, includes forming a crown cap with jagged or tooth-shaped sharp edges. A following or subsequent step in the method as shown in FIG. 27, shown by 202, includes inserting a sealing material between cavities in at least a portion of the crown cork. A following or subsequent step in the method as shown in FIG. 27, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 27, shown by 210, includes the ring, when closed, forming a contour which exhibits, in the direction of the container axis of the upright container, a downwards inclination or cambering. A following or subsequent step in the method as shown in FIG. 27, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 28:
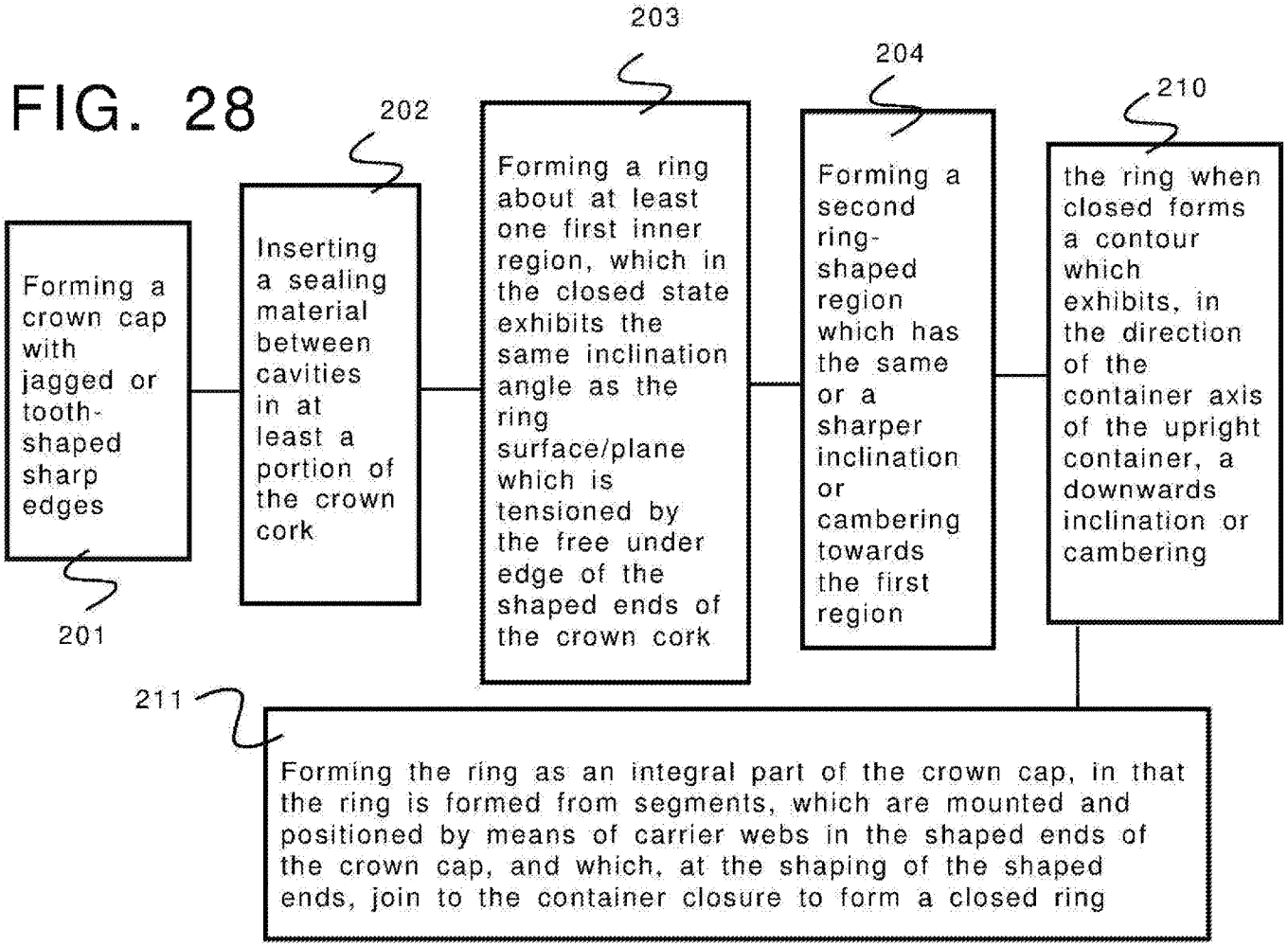
FIG. 28 is a block diagram of one possible exemplification of the method according to the present application.

FIG. 28 is a block diagram of one possible exemplification of the method according to the present application. One step in the method as shown in FIG. 28, shown by 201, includes forming a crown cap with jagged or tooth-shaped sharp edges. A following or subsequent step in the method as shown in FIG. 28, shown by 202, includes inserting a sealing material between cavities in at least a portion of the crown cork. A following or subsequent step in the method as shown in FIG. 28, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 28, shown by 204, includes forming a second ring-shaped region which has the same or a sharper inclination or cambering towards the first region. A following or subsequent step in the method as shown in FIG. 28, shown by 210, includes the ring, when closed, forming a contour which exhibits, in the direction of the container axis of the upright container, a downwards inclination or cambering. A following or subsequent step in the method as shown in FIG. 28, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 29:
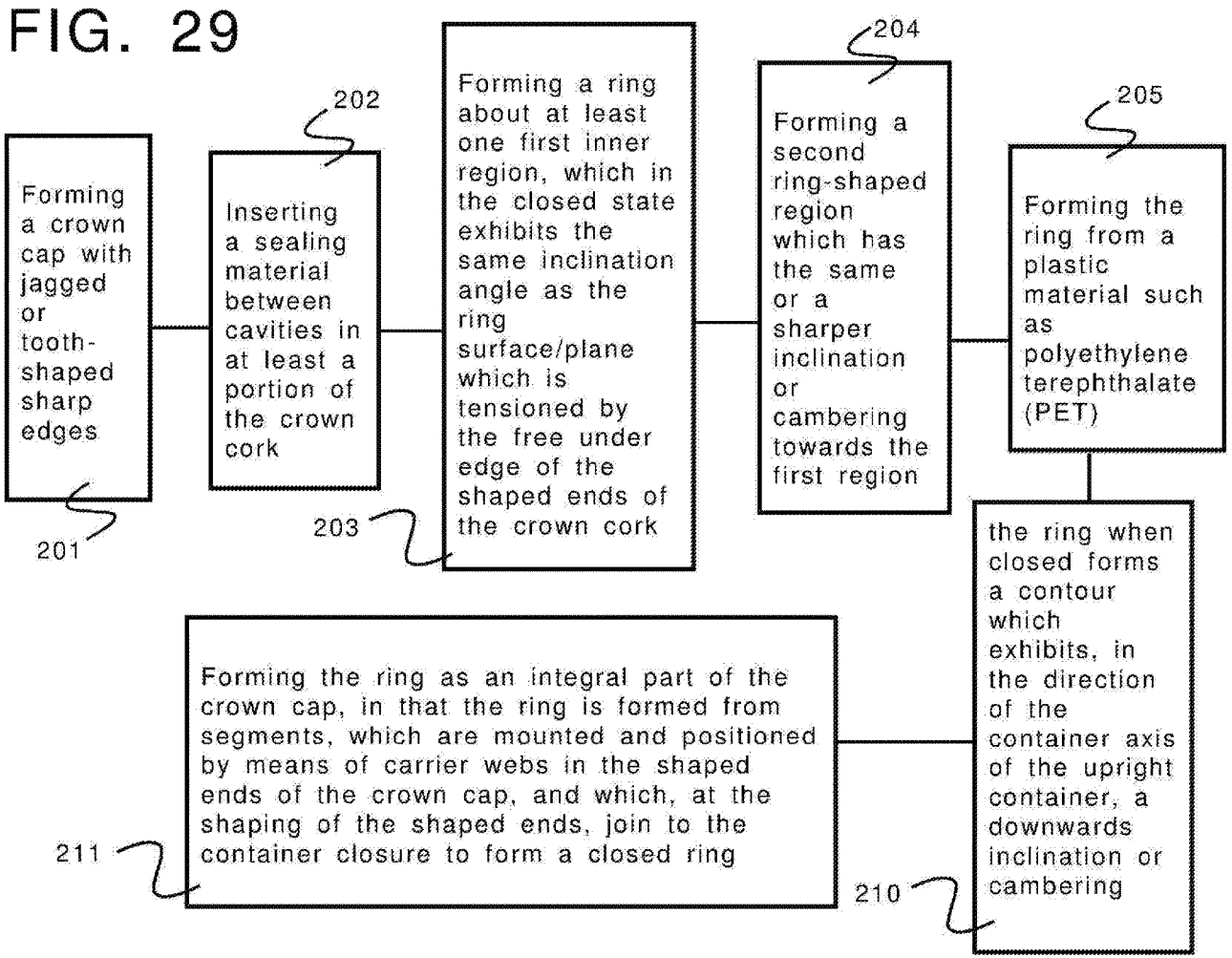
FIG. 29 is a block diagram of one possible exemplification of the method according to the present application.

FIG. 29 is a block diagram of one possible exemplification of the method according to the present application. One step in the method as shown in FIG. 29, shown by 201, includes forming a crown cap with jagged or tooth-shaped sharp edges. A following or subsequent step in the method as shown in FIG. 29, shown by 202, includes inserting a sealing material between cavities in at least a portion of the crown cork. A following or subsequent step in the method as shown in FIG. 29, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 29, shown by 204, includes forming a second ring-shaped region which has the same or a sharper inclination or cambering towards the first region. A following or subsequent step in the method as shown in FIG. 29, shown by 205, includes forming the ring from a plastic material such as polyethylene terephthalate (PET). A following or subsequent step in the method as shown in FIG. 29, shown by 210, includes the ring, when closed, forming a contour which exhibits, in the direction of the container axis of the upright container, a downwards inclination or cambering. A following or subsequent step in the method as shown in FIG. 29, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 30:
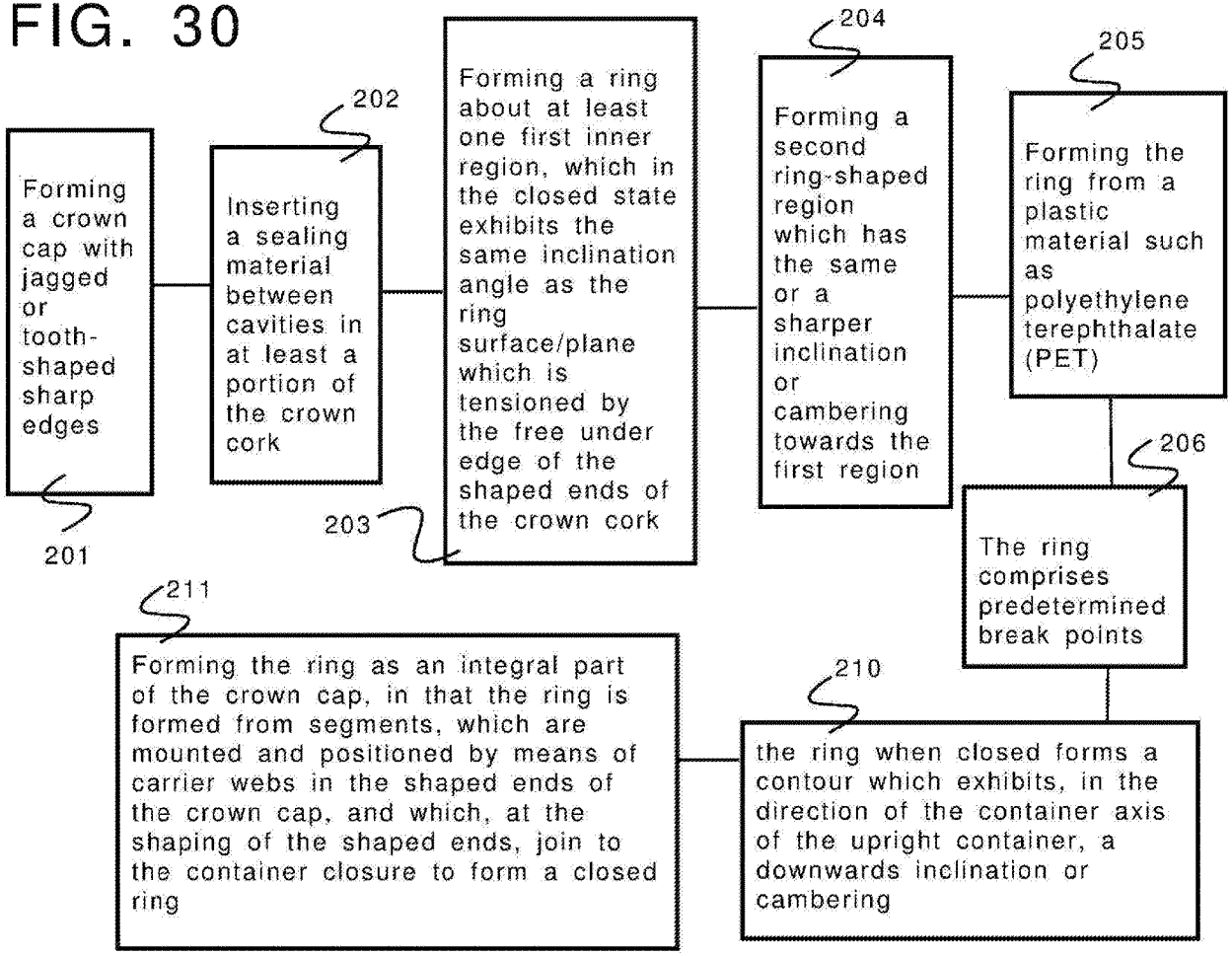
FIG. 30 is a block diagram of one possible exemplification of the method according to the present application.

FIG. 30 is a block diagram of one possible exemplification of the method according to the present application. One step in the method as shown in FIG. 30, shown by 201, includes forming a crown cap with jagged or tooth-shaped sharp edges. A following or subsequent step in the method as shown in FIG. 30, shown by 202, includes inserting a sealing material between cavities in at least a portion of the crown cork. A following or subsequent step in the method as shown in FIG. 30, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 30, shown by 204, includes forming a second ring-shaped region which has the same or a sharper inclination or cambering towards the first region. A following or subsequent step in the method as shown in FIG. 30, shown by 205, includes forming the ring from a plastic material such as polyethylene terephthalate (PET). A following or subsequent step in the method as shown in FIG. 30, shown by 206, includes the ring comprising predetermined break points. A following or subsequent step in the method as shown in FIG. 30, shown by 210, includes the ring, when closed, forming a contour which exhibits, in the direction of the container axis of the upright container, a downwards inclination or cambering. A following or subsequent step in the method as shown in FIG. 30, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 31A:
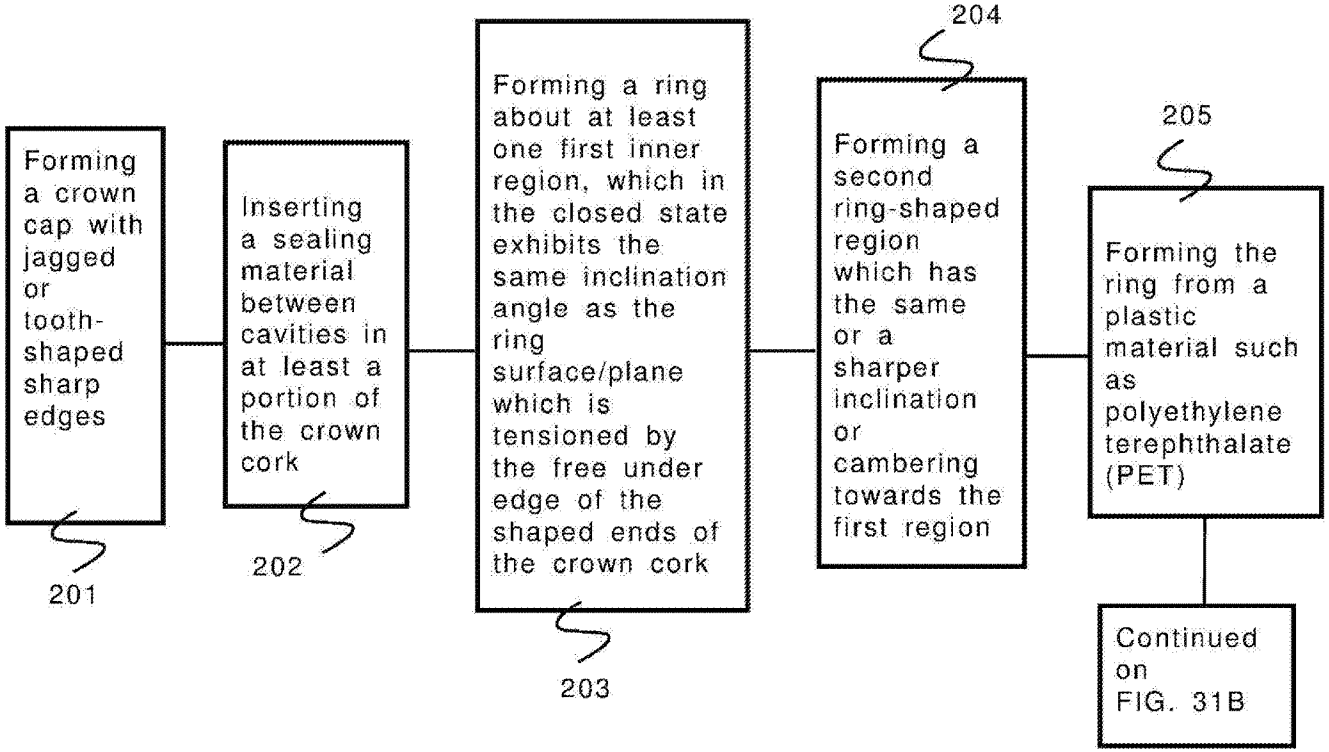
FIG. 31A is a block diagram of one portion of one possible exemplification of the method according to the present application.

FIG. 31A is a block diagram of one possible exemplification of the method according to the present application. One step in the method as shown in FIG. 31A, shown by 201, includes forming a crown cap with jagged or tooth-shaped sharp edges. A following or subsequent step in the method as shown in FIG. 31A, shown by 202, includes inserting a sealing material between cavities in at least a portion of the crown cork. A following or subsequent step in the method as shown in FIG. 31A, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 31A, shown by 204, includes forming a second ring-shaped region which has the same or a sharper inclination or cambering towards the first region. A following or subsequent step in the method as shown in FIG. 31A, shown by 205, includes forming the ring from a plastic material such as polyethylene terephthalate (PET).

Figure 31B:
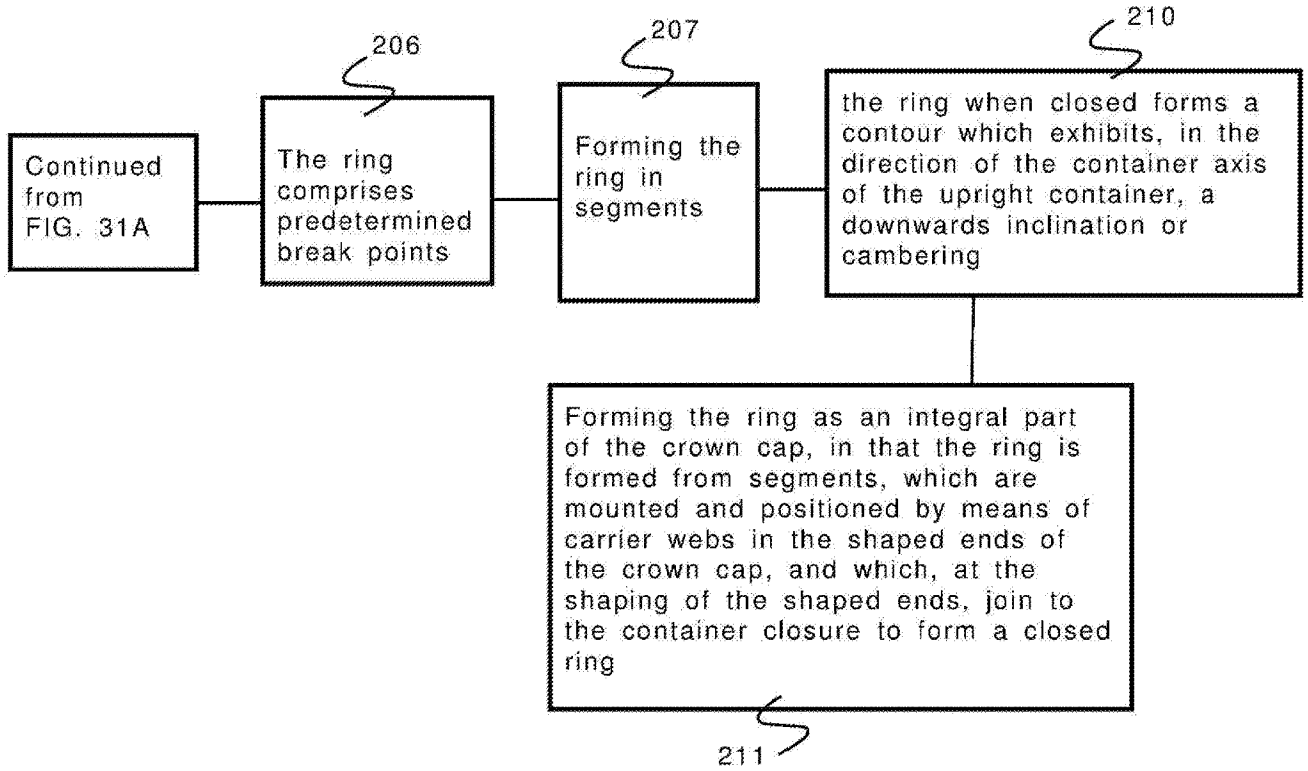
FIG. 31B is a block diagram of the other portion of the one possible exemplification of the method shown in FIG. 31A.

FIG. 31B shows the continuation of the method shown in FIG. 31A. A following or subsequent step in the method as shown in FIG. 31A, shown by 206, includes the ring comprising predetermined break points. A following or subsequent step in the method as shown in FIG. 31B, shown by 207, includes forming the ring in segments. A following or subsequent step in the method as shown in FIG. 31B, shown by 210, includes the ring, when closed, forming a contour which exhibits, in the direction of the container axis of the upright container, a downwards inclination or cambering. A following or subsequent step in the method as shown in FIG. 31B, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 32A:
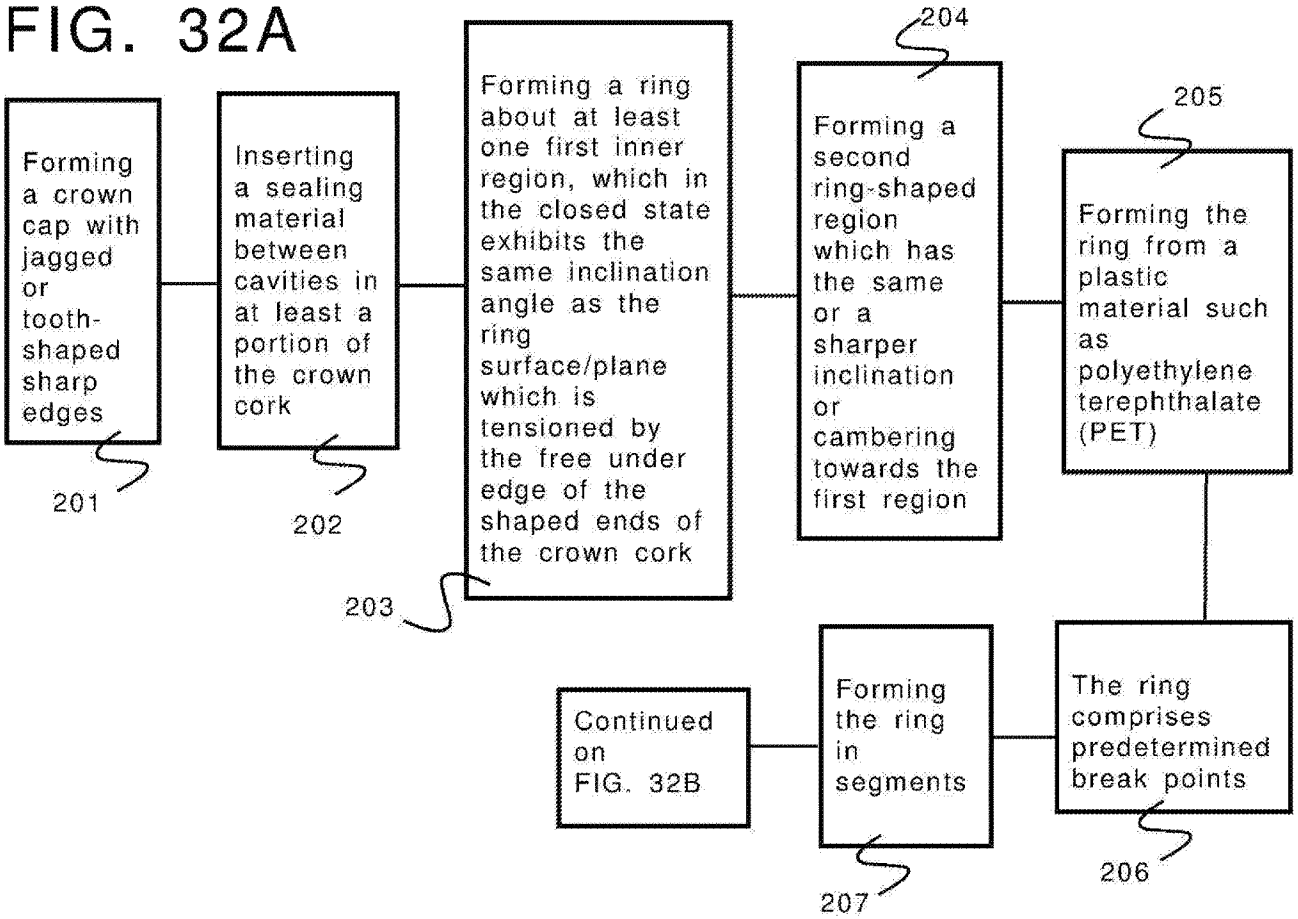
FIG. 32A is a block diagram of one portion of one possible exemplification of the method according to the present application.

FIG. 32A is a block diagram of one possible exemplification of the method according to the present application. One step in the method as shown in FIG. 32A, shown by 201, includes forming a crown cap with jagged or tooth-shaped sharp edges. A following or subsequent step in the method as shown in FIG. 32A, shown by 202, includes inserting a sealing material between cavities in at least a portion of the crown cork. A following or subsequent step in the method as shown in FIG. 32A, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 32A, shown by 204, includes forming a second ring-shaped region which has the same or a sharper inclination or cambering towards the first region. A following or subsequent step in the method as shown in FIG. 32A, shown by 205, includes forming the ring from a plastic material such as polyethylene terephthalate (PET). A following or subsequent step in the method as shown in FIG. 32A, shown by 206, includes the ring comprising predetermined break points. A following or subsequent step in the method as shown in FIG. 32A, shown by 207, includes forming the ring in segments.

Figure 32B:
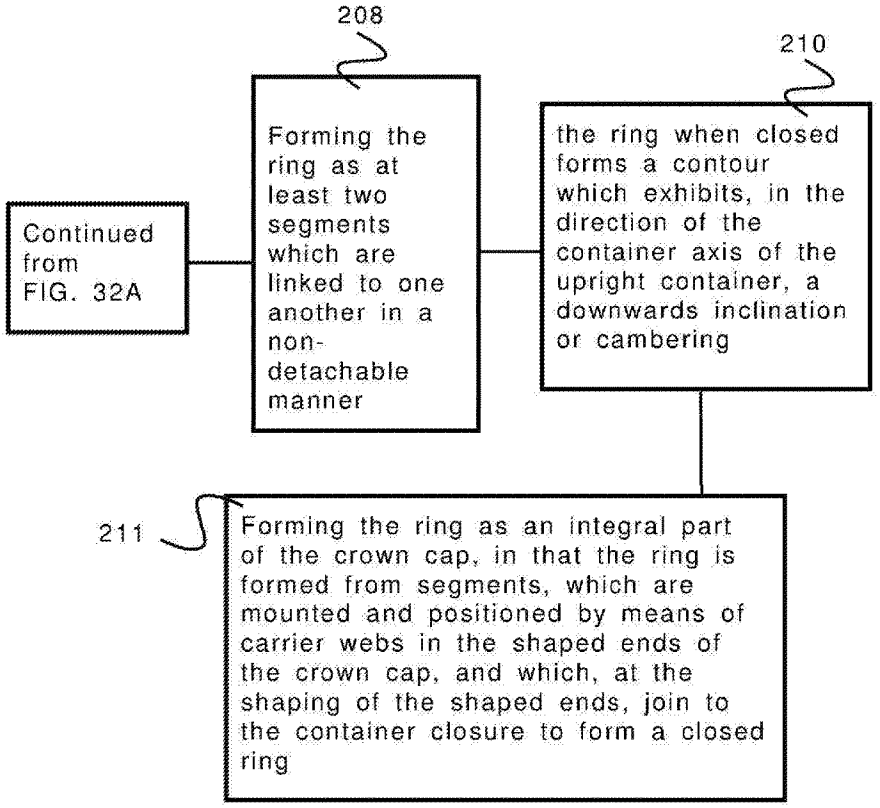
FIG. 32B is a block diagram of the other portion of the one possible exemplification of the method shown in FIG. 32A.

FIG. 32B shows the continuation of the method shown in FIG. 32A. A following or subsequent step in the method as shown in FIG. 32A, shown by 208, includes forming the ring as at least two segments which are linked to one another in a non-detachable manner. A following or subsequent step in the method as shown in FIG. 32B, shown by 210, includes the ring, when closed, forming a contour which exhibits, in the direction of the container axis of the upright container, a downwards inclination or cambering. A following or subsequent step in the method as shown in FIG. 32B, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 33A:
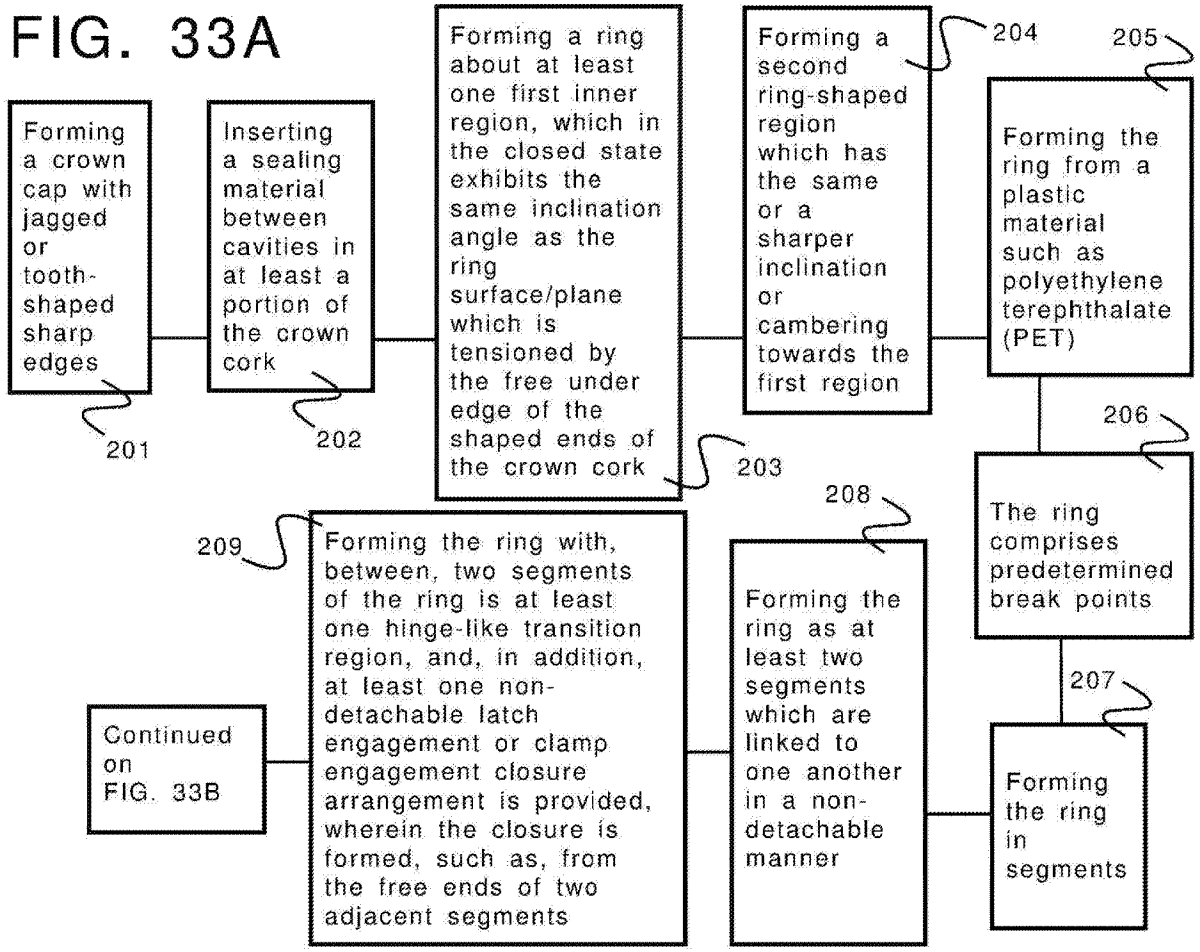
FIG. 33A is a block diagram of one portion of one possible exemplification of the method according to the present application.

FIG. 33A is a block diagram of one possible exemplification of the method according to the present application. One step in the method as shown in FIG. 33A, shown by 201, includes forming a crown cap with jagged or tooth-shaped sharp edges. A following or subsequent step in the method as shown in FIG. 33A, shown by 202, includes inserting a sealing material between cavities in at least a portion of the crown cork. A following or subsequent step in the method as shown in FIG. 33A, shown by 203, includes forming a ring about at least one first inner region, which in the closed state exhibits the same inclination angle as the ring surface/plane which is tensioned by the free under edge of the shaped ends of the crown cork. A following or subsequent step in the method as shown in FIG. 33A shown by 204, includes forming a second ring-shaped region which has the same or a sharper inclination or cambering towards the first region. A following or subsequent step in the method as shown in FIG. 33A, shown by 205, includes forming the ring from a plastic material such as polyethylene terephthalate (PET). A following or subsequent step in the method as shown in FIG. 33A, shown by 206, includes the ring comprising predetermined break points. A following or subsequent step in the method as shown in FIG. 33A, shown by 207, includes forming the ring in segments. A following or subsequent step in the method as shown in FIG. 33A, shown by 208, includes forming the ring as at least two segments which are linked to one another in a non-detachable manner. A following or subsequent step to the method as shown in FIG. 33A, shown by 209, includes forming the ring with, between, two segments of the ring is at least one hinge-like transition region, and, in addition, at least one non-detachable latch engagement or clamp engagement closure arrangement is provided, wherein the closure is formed, such as, from the free ends of two adjacent segments.

Figure 33B:
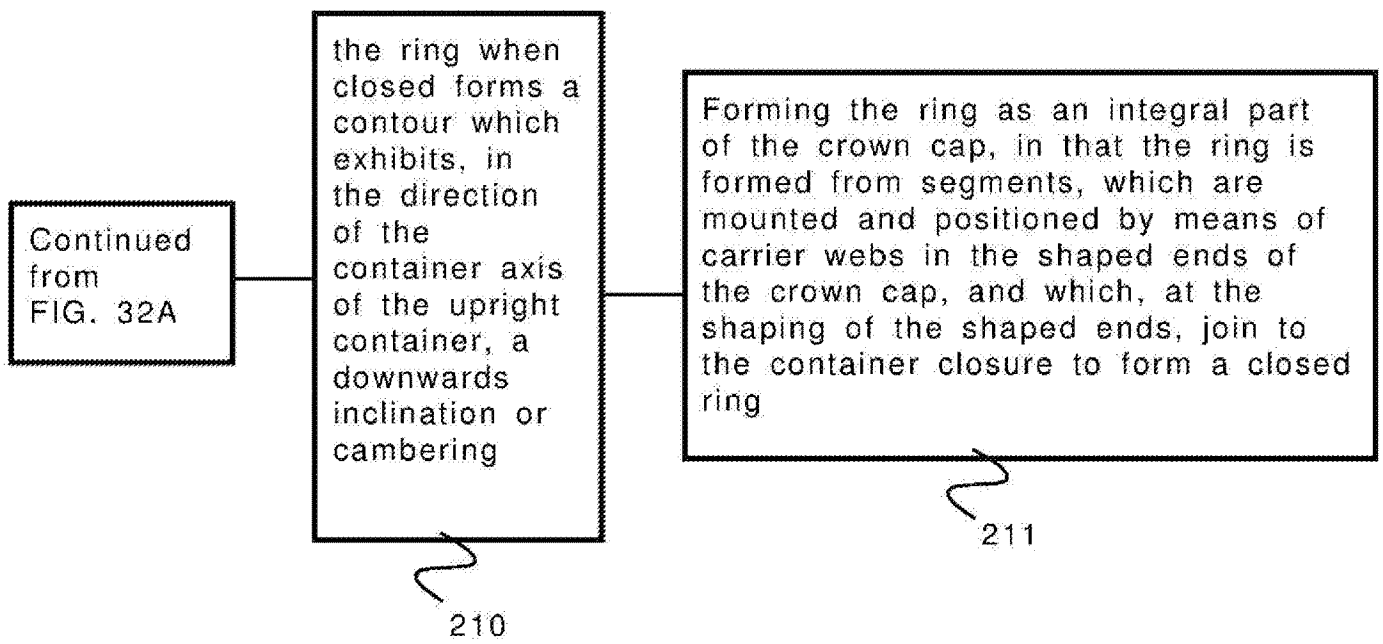
FIG. 33B is a block diagram of the other portion of the one possible exemplification of the method shown in FIG. 33A.

FIG. 33B shows the continuation of the method shown in FIG. 33A. following or subsequent step in the method as shown in FIG. 33A, shown by 210, includes the ring, when closed, forming a contour which exhibits, in the direction of the container axis of the upright container, a downwards inclination or cambering. A following or subsequent step in the method as shown in FIG. 33B, shown by 211, includes forming the ring as an integral part of the crown cap, in that the ring is formed from segments, which are mounted and positioned by means of carrier webs in the shaped ends of the crown cap, and which, at the shaping of the shaped ends, join to the container closure to form a closed ring.

Figure 34:
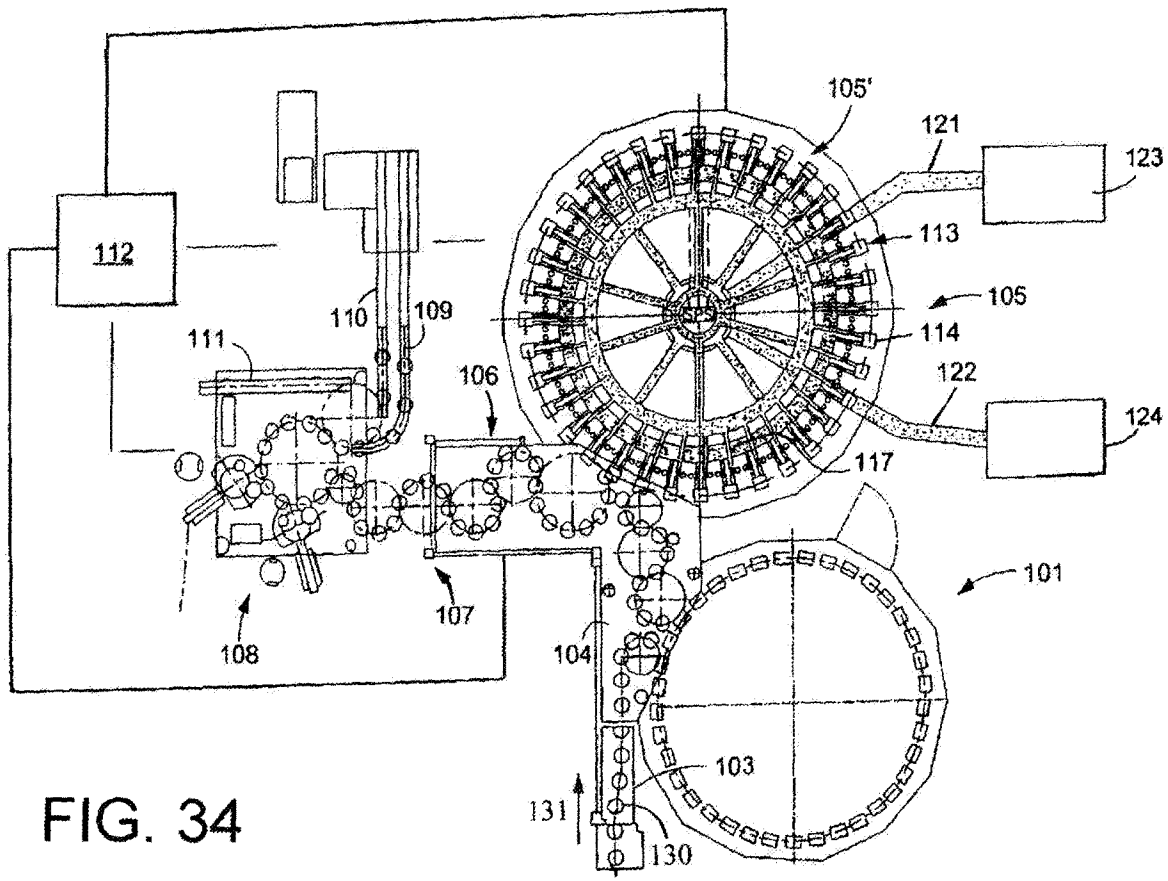
FIG. 34 shows schematically the main components of one possible embodiment example of a system for filling containers.

FIG. 34 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 34 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 34, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application comprises a method and a device for closing containers with a cap-like closing system in which an additional retaining ring is provided underneath the closure.

One feature or aspect of an exemplification is believed at the time of the filing of this patent application to possibly reside broadly in a cap-like closing system for containers, comprising a crown cap which in turn comprises a plurality of jagged or tooth-shaped shaped ends, and which is formed at least partially from a metallic or aluminum-containing material, wherein the crown cap is shaped in such a way that the shaped ends, after being shaped in the specified manner and closing the container, form one or more cavities between the outer container surface and the shaped ends, wherein, beneath the crown cap, a ring or ring element projects in the axial direction, which represents a lower delimiting wall of the cavities, wherein the ring comprises at least one first inner region, which in the closed state exhibits the same inclination angle as the ring surface/plane which is tensioned by the free under edge of the shaped ends.

Another feature or aspect of an exemplification is believed at the time of the filing of this patent application to possibly reside broadly in the cap-like closure element, wherein connected to the first inner region is a second ring-shaped region, which exhibits the same or a sharper inclination or cambering towards the first region.

Yet another feature or aspect of an exemplification is believed at the time of the filing of this patent application to possibly reside broadly in the cap-like closure element, wherein the ring is formed from a plastic, in one possible exemplification from polyethylene terephthalate (PET).

Still another feature or aspect of an exemplification is believed at the time of the filing of this patent application to possibly reside broadly in the cap-like closure element, wherein the ring comprises predetermined break points.

A further feature or aspect of an exemplification is believed at the time of the filing of this patent application to possibly reside broadly in the cap-like closure element, wherein the ring is formed from segments.

Another feature or aspect of an exemplification is believed at the time of the filing of this patent application to possibly reside broadly in the cap-like closure element, wherein the ring is formed from at least two segments which can be latched into one another in a non-detachable manner.

Yet another feature or aspect of an exemplification is believed at the time of the filing of this patent application to possibly reside broadly in the cap-like closure element, wherein, formed between two segments of the ring is at least one hinge-like transition region, and, in addition, at least one non-detachable latch engagement or clamp engagement closure arrangement is provided, wherein the closure is formed, for example, from the free ends of two adjacent segments.

Still another feature or aspect of an exemplification is believed at the time of the filing of this patent application to possibly reside broadly in the cap-like closure element, wherein the closed ring comprises a contour which exhibits, in the direction of the container axis of the upright container, a downwards inclination or cambering.

A further feature or aspect of an exemplification is believed at the time of the filing of this patent application to possibly reside broadly in the cap-like closure element, wherein the ring forms an integral part of the crown cap, in that the ring is formed from segments, which are mounted and positioned by means of carrier webs in the shaped ends of the crown cap, and which, at the shaping of the shaped ends, join to the container closure to form a closed ring.

One feature or aspect of an exemplification is believed at the time of the filing of this patent application to possibly reside broadly in a method for closing containers with a cap-like closure system according to the present application, wherein the containers and the crown caps are conveyed to the closure device, wherein in a first step, the ring is conveyed to the closing device, in a further step, the ring is arranged on or at the mouth region of the container, and in a subsequent step, simultaneously or after the step of shaping the shaped ends of the crown cap, a closure and latching step of the ring takes place.

Another feature or aspect of an exemplification is believed at the time of the filing of this patent application to possibly reside broadly in the method, wherein the free ends of the shaped ends, during the shaping, come in contact on the ring, and push this by a defined distance downwards in the direction of the container axis and therefore tension it and press it in non-positive fit around the container mouth.

Yet another feature or aspect of an exemplification is believed at the time of the filing of this patent application to possibly reside broadly in the method, wherein the ring is conveyed independently of the crown caps, and secured on or at the container mouth.

Still another feature or aspect of an exemplification is believed at the time of the filing of this patent application to possibly reside broadly in the method, wherein the ring is conveyed in segments.

The components disclosed in the patents, patent applications, patent publications, and other documents disclosed or incorporated by reference herein, may possibly be used in possible exemplifications of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one exemplification of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various exemplifications may be used with at least one exemplification or all of the exemplifications, if more than one exemplification is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents cited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible exemplification of the present application . . . " may possibly not be used or useable in any one or more exemplifications of the application.

The sentence immediately above relates to patents, patent applications, patent publications, and other documents either incorporated by reference or not incorporated by reference.

U.S. patent application Ser. No. 15/277,382, filed on Sep. 27, 2016, having inventors Heinz HILLMANN and Andreas KRIEG, and title CROWN CORK CLOSURE AND CLOSING METHOD, and its corresponding Federal Republic of Germany Patent Application No. 10 2014 104 322.7, filed on Mar. 27, 2014, and International Patent Application No. PCT/EP2015/056264, filed on Mar. 24, 2015, having WIPO Publication No. WO 2015 144710 A1 and inventors Heinz HILLMANN and Andreas FAHLDIECK are hereby incorporated by reference as if set forth in their entirety herein.

U.S. patent application Ser. No. 15/277,018, filed on Sep. 27, 2016, having inventors Heinz HILLMANN and Andreas KRIEG, and title CROWN CAP CLOSURE AND CLOSURE METHOD, and its corresponding Federal Republic of Germany Patent Application No. 10 2014 104 323.5, filed on Mar. 27, 2014, and International Patent Application No. PCT/EP2015/056266, filed on Mar. 24, 2015, having WIPO Publication No. WO 2015/144711 and inventors Heinz HILLMANN and Andreas FAHLDIECK are hereby incorporated by reference as if set forth in their entirety herein.

The following patents, patent applications, patent publications, and other documents, except for the exceptions indicated herein, are hereby incorporated by reference as if set forth in their entirety herein except for the exceptions indicated herein: DE 4018121 A1, having the English translation of the German title "Filling and closing bottles—involves mechanism which forms seal press seat between closure and bottle", published on Dec. 12, 1991; DE 1018121 A1, having the German title "Freiluft-Hochspannungsverbundisolator aus Kunststoff", published on Oct. 24, 1957; and DE 35 15 334 A1, having the English translation of the German title "VESSEL CLOSING MACHINE", published on Oct. 30, 1986.

All of the patents, patent applications, patent publications, and other documents, except for the exceptions indicated herein, which were cited in the German Office Action dated Jul. 8, 2015, and/or cited elsewhere, as well as the German Office Action document itself, are hereby incorporated by reference as if set forth in their entirety herein except for the exceptions indicated herein, as follows: DE 10 2014 010 626 A1, having the German title "Verschluss einer Flasche mit einem Kronkorken", published on May 7, 2015; DE 4036306 A1, having the English translation of the German title "Fitting sealing caps to filled bottles", published on Jun. 4, 1992; and U.S. Pat. No. 1,490,022 A, having the title "Combined bottle cap and remover", published on Apr. 8, 1924.

All of the patents, patent applications, patent publications, and other documents, except for the exceptions indicated herein, which were cited in the International Search Report dated May 19, 2015, and/or cited elsewhere, as well as the International Search Report document itself, are hereby incorporated by reference as if set forth in their entirety herein except for the exceptions indicated herein, as follows: U.S. Pat. No. 2,974,816 A, having the title "Closing and sealing bottles and other receptacles", published on Mar. 14, 1961.

The corresponding foreign and international patent publication applications, namely, Federal Republic of Germany Patent Application No. 10 2014 104 316.2, filed on Mar. 27, 2014, having inventors Heinz HILLMANN and Andreas KRIEG, and DE-OS 10 2014 104 316.2 and DE-PS 10 2014 104 316.2, and International Application No. PCT/EP2015/056263, filed on Mar. 24, 2015, having WIPO Publication No. WO 2015/144709 A1 and inventors Heinz HILLMANN and Andreas KRIEG, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications, patent publications, and other documents, except for the exceptions indicated herein, are hereby incorporated by reference as if set forth in their entirety herein except for the exceptions indicated herein.

The purpose of incorporating the corresponding foreign equivalent patent application(s), that is, PCT/EP2015/056263 and German Patent Application 10 2014 104 316.2, is solely for the purposes of providing a basis of correction of any wording in the pages of the present application, which may have been mistranslated or misinterpreted by the translator, and to provide additional information relating to technical features of one or more exemplifications, which information may not be completely disclosed in the wording in the pages of this application.

Statements made in the original foreign patent applications PCT/EP2015/056263 and DE 10 2014 104 316.2 from which this patent application claims priority which do not have to do with the correction of the translation in this patent application are not to be included in this patent application in the incorporation by reference.

Any statements about admissions of prior art in the original foreign patent applications PCT/EP2015/056263 and DE 10 2014 104 316.2 are not to be included in this patent application in the incorporation by reference, since the laws relating to prior art in non-U.S. Patent Offices and courts may be substantially different from the Patent Laws of the United States.

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the exemplifications therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more exemplifications of the patents, patent applications, patent publications, and other documents, are not considered to be incorporated by reference herein for any of the patents, patent applications, patent publications, and other documents cited herein.

The description of the exemplification or exemplifications is believed, at the time of the filing of this patent application, to adequately describe the exemplification or exemplifications of this patent application. However, portions of the description of the exemplification or exemplifications may not be completely applicable to the claims as originally filed in this patent application, as amended during prosecution of this patent application, and as ultimately allowed in any patent issuing from this patent application. Therefore, any statements made relating to the exemplification or exemplifications are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the exemplification or exemplifications, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. § 1.72(b). As stated in 37 C.F.R. § 1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The exemplifications of the invention described herein above in the context of the preferred exemplifications are not to be taken as limiting the exemplifications of the invention to all of the provided details thereof, since modifications and variations thereof may be made without departing from the spirit and scope of the exemplifications of the invention.

What is claimed is:

1. A capping arrangement for closing bottles or similar containers, said capping arrangement comprising:

a crown cap comprising aluminum or other metallic material;

said crown cap comprising a cover portion configured to cover a mouth opening of a container;

said crown cap comprising a side portion extending transversely from said cover portion and ending in an exposed edge;

said side portion being configured to surround and clamp onto a lip portion of a mouth of a container;

said side portion having an essentially corrugated shape comprising a plurality of teeth formed by alternating projections and indentations;

said teeth being configured to project out such that spaces are formed within said projections and between said indentations;

a ring-shaped element being disposed at said exposed edge to cover at least substantially all of said spaces within said teeth;

said ring-shaped element comprising a first surface disposed to face said exposed edge, and a second surface disposed opposite said first surface;

said exposed edge being inclined at an angle with respect to a plane lying in and extending from the circumference of said cover portion; and said first surface of said ring-shaped element having an essentially conical shape being inclined at essentially the same angle as said exposed edge, such that substantially all of said exposed edge is disposed immediately adjacent and/or in contact with said first surface of said ring-shaped element, and such that said first surface is disposed to extend transverse to said side portion.

2. The capping arrangement according to claim 1, wherein said second surface of said ring-shaped element has an essentially conical shape inclined at essentially the same angle as said first surface of said ring-shaped element, or inclined at a greater angle than said first surface, with respect to the plane lying in and extending from the circumference of said cover portion.

3. The capping arrangement according to claim 2, wherein said ring-shaped element comprises polyethylene terephthalate (PET) or another plastic material.

4. The capping arrangement according to claim 3, wherein said ring-shaped element comprises narrowed portions of reduced thickness which comprise break points configured to permit breaking of said ring-shaped element upon removal of the crown cap from a container.

5. The capping arrangement according to claim 4, wherein said ring-shaped element comprises segments.

6. The capping arrangement according to claim 5, wherein said ring-shaped element comprises at least two separate segments configured to be connected together in a non-detachable manner.

7. The capping arrangement according to claim 6, wherein:

said at least two segments of said ring-shaped element comprise a first segment and a second segment;

said first segment comprises a projecting structure disposed to project from one end of said first segment;

said second segment comprises a receiving structure disposed in one end of said second segment; and said projecting structure is configured to be inserted into said receiving structure to form a non-detachable, latching or clamping connection comprising a hinge-like or fixed structure.

8. The capping arrangement according to claim 7, wherein portions of said exposed edge at said projections are disposed closer to the plane lying in and extending from the circumference of said cover portion, as measured in a direction perpendicular to the plane, than portions of said exposed edge at said indentations.

9. The capping arrangement according to claim 1, wherein:

said ring-shaped element is formed integrally with said crown cap;

said segments of said ring-shaped element are attached by webs onto said teeth of said crown cap; and said segments are positioned on said teeth such that, upon deformation and forming of said side portion, said segments are disposed immediately adjacent and/or in contact with one another to form a closed ring about a container.

10. The capping arrangement according to claim 1, wherein said first surface is inclined such that inner portions of said first surface adjacent said indentations are disposed further from the plane lying in and extending from the circumference of said cover portion, as measured in a direction perpendicular to the plane, than outer portions of said first surface adjacent said projections.

11. The capping arrangement according to claim 2, wherein said first surface is inclined such that inner portions of said first surface adjacent said indentations are disposed further from the plane lying in and extending from the circumference of said cover portion, as measured in a direction perpendicular to the plane, than outer portions of said first surface adjacent said projections.

12. The capping arrangement according to claim 11, wherein said second surface is inclined such that inner portions of said second surface adjacent said indentations are disposed closer to the plane lying in and extending from the circumference of said cover portion, as measured in a direction perpendicular to the plane, than outer portions of said second surface adjacent said projections.

13. The capping arrangement according to claim 2, wherein said second surface is inclined such that inner portions of said second surface adjacent said indentations are disposed closer to the plane lying in and extending from the circumference of said cover portion, as measured in a direction perpendicular to the plane, than outer portions of said second surface adjacent said projections.

14. The capping arrangement according to claim 1, wherein said ring-shaped element comprises segments.

15. The capping arrangement according to claim 14, wherein said ring-shaped element comprises at least two separate segments configured to be connected together in a non-detachable manner.

16. The capping arrangement according to claim 15, wherein:

said at least two segments of said ring-shaped element comprise a first segment and a second segment;

said first segment comprises a projecting structure disposed to project from one end of said first segment;

said second segment comprises a receiving structure disposed in one end of said second segment; and said projecting structure is configured to be inserted into said receiving structure to form a non-detachable, latching or clamping connection comprising a hinge-like or fixed structure.

17. The capping arrangement according to claim 1, wherein said first surface comprises at least one projection configured to engage with a portion of said exposed edge, which said at least one projection promotes breaking of said ring-shaped element upon removal of the crown cap from a container.

18. The capping arrangement according to claim 1, wherein:

said ring-shaped element comprises an outer side surface and an inner side surface, each disposed transverse to said first surface; and said inner side surface being disposed essentially perpendicular to the plane lying in and extending from the circumference of said cover portion.

19. The capping arrangement according to claim 18, wherein said inner side surface comprises recesses or openings therein to provide gaps between said inner side surface and an outer surface of a container on which the capping arrangement is installed.

20. The capping arrangement according to claim 19, wherein:

said first surface is inclined such that inner portions of said first surface adjacent said indentations are disposed further from the plane lying in and extending from the circumference of said cover portion, as measured in a direction perpendicular to the plane, than outer portions of said first surface adjacent said projections; and said second surface is inclined such that inner portions of said second surface adjacent said indentations are disposed closer to the plane lying in and extending from the circumference of said cover portion, as measured in a direction perpendicular to the plane, than outer portions of said second surface adjacent said projections.

* * * * *